US005131372A

United States Patent [19]

Nakaniwa

[11] Patent Number: 5,131,372

[45] Date of Patent: Jul. 21, 1992

[54] APPARATUS FOR CONTROLLING THE RESPECTIVE CYLINDERS IN THE FUEL SUPPLY SYSTEM OF AN INTERNAL COMBUSTION ENGINE

[75] Inventor: Shinpei Nakaniwa, Isesaki, Japan

[73] Assignee: Japan Electronic Control Systems Co., Ltd., Isesaki, Japan

[21] Appl. No.: 635,508

[22] Filed: Jan. 15, 1991

[30] Foreign Application Priority Data

May 15, 1989 [JP] Japan ..... 1-118687

[51] Int. Cl.[5] ..... F02D 41/14; F02D 41/22

[52] U.S. Cl. ..... 123/673; 123/674; 123/690

[58] Field of Search ..... 123/440, 489, 479

[56] References Cited

U.S. PATENT DOCUMENTS

| | | | |
|---|---|---|---|
| 4,231,334 | 11/1980 | Peter | 123/440 |
| 4,476,833 | 10/1984 | Johnson et al. | 123/436 |
| 4,483,330 | 11/1984 | Hosaka et al. | 123/489 |
| 4,616,617 | 10/1986 | Geiger et al. | 123/436 |
| 4,627,402 | 12/1986 | Saito et al. | 123/440 |
| 4,628,884 | 12/1986 | Geering et al. | 123/489 |
| 4,703,735 | 11/1987 | Minamitami et al. | 123/440 |
| 4,718,015 | 1/1988 | Grob et al. | 364/431.05 |
| 4,971,010 | 11/1990 | Iwata | 123/435 |

FOREIGN PATENT DOCUMENTS

| | | | |
|---|---|---|---|
| 0075550 | 6/1980 | Japan | 123/489 |
| 57-122144 | 7/1982 | Japan . | |
| 57-126527 | 8/1982 | Japan . | |
| 59-221434 | 12/1984 | Japan . | |
| 60-45781 | 3/1985 | Japan . | |
| 60-216243 | 10/1985 | Japan . | |
| 60-240840 | 11/1985 | Japan . | |

OTHER PUBLICATIONS

Patent Abstracts of Japan, Abstract Pub. date, Mar. 24, 1988, vol. 012-091, Publication No. 62228640.

Patent Abstracts of Japan, Abstract Pub. date, Feb. 10, 1989, vol. 013-060, Publication No. 63263241.

*Primary Examiner*—Tony M. Argenbright

*Attorney, Agent, or Firm*—Foley & Lardner

[57] ABSTRACT

Only an air-fuel ratio of one specific cylinder is forcibly shifted by the correction of the fuel supply quantity, and the fuel supply characteristic error rate of fuel supply means of this one specific cylinder, where the air-fuel ratio is forcibly shifted is detected based on whether or not the influence of this shifting of the air-fuel ratio is manifested on the air-fuel ratio feedback correction value set, based on the average air-fuel ratio in respective cylinders, as expected. Correction values of the fuel supply quantity are set separately for respective cylinders, based on the fuel supply characteristic error rates thus determined separately for respective cylinders.

11 Claims, 16 Drawing Sheets

BGJ
START
S161
|n1|: PREDETERMINED VALUE ?
≧
<
S162
DISPLAY OF #1 F/I Ts NG
S163
|n2|: PREDETERMINED VALUE ?
≧
<
S164
DISPLAY OF #2 F/I Ts NG
S165
|n3|: PREDETERMINED VALUE ?
≧
<
S166
DISPLAY OF #3 F/I Ts NG
S167
|n4|: PREDETERMINED VALUE ?
≧
<
S168
DISPLAY OF #4 F/I Ts NG
S169
|m1-1|: PREDETERMINED VALUE ?
≧
<
S170
DISPLAY OF #1 F/I CLOGGING
S171
|m2-1|: PREDETERMINED VALUE ?
≧
<
S172
DISPLAY OF #2 F/I CLOGGING

APPARATUS FOR CONTROLLING THE RESPECTIVE CYLINDERS IN THE FUEL SUPPLY SYSTEM OF AN INTERNAL COMBUSTION ENGINE

TECHNICAL FIELD

The present invention relates to a diagnosis apparatus in a fuel supply control system equipped with a function of performing the feedback control of the air-fuel ratio, which is disposed to detect dispersions of supply characteristics of fuel supply means such as fuel injection valves arranged for respective cylinders and make the diagnosis of the fuel supply means based on the results of detection of the dispersions and the results of learning and correction.

BACKGROUND ART

The following apparatuses have been known as the fuel supply control system of an internal combustion engine.

More specifically, an intake air flow quantity Q or an intake air pressure PB is detected as the state quantity participating in sucked air, and based on this detected value and the detection value of the engine revolution number N, the basic fuel supply quantity Tp is computed. This basic fuel supply quantity is corrected based on various coefficients sets COEF based on the driving states, such as the engine temperature represented by the cooling water temperature, the air-fuel ratio feedback correction coefficient LMD set based on the air-fuel ratio in the sucked air-fuel mixture detected through the oxygen concentration in the exhaust gas and a correction portion Ts for correcting the opening-closing delay of the fuel injection valve caused by changes of the battery voltage, and the final fuel supply quantity Ti is thus computer ($Ti \leftarrow Tp \times COEF \times LMD + Ts$) and this computed quantity of a fuel is intermittently supplied to the engine by the fuel injection valve (see, for example, Japanese Unexamined Patent Publication No. 60-240840).

The air-fuel ratio feedback correction coefficient is set, for example, by the proportional-integral control, and in the case where the actual air-fuel ratio detected through the oxygen concentration in the exhaust gases by an oxygen sensor is richer (leaner) than the target air-fuel ratio (theoretical air-fuel ratio), the air-fuel ratio feedback correction coefficient LMD is first decreased (increased) only by the predetermined proportional portion P and is then decreased (increased) by the predetermined integral portion I synchronously with the time or synchronously with the revolution of the engine, and the control is performed so that the actual air-fuel ratio is reversed repeatedly in the vicinity of the target air-fuel ratio.

In an electromagnetic fuel injection valve ordinarily used for injecting and supplying a fuel into an engine, the flow quantity characteristics are changed with the lapse of time or by intrusion of foreign substances or clogging of injection holes, and even in the state of new products, there is present a dispersion of about ±6% in the flow characteristics because of a production tolerance.

Accordingly, in the case where injection valves are disposed independently for respective cylinders, even if the driving control is carried out in all the cylinders based on the same fuel supply quantity, because of the above-mentioned dispersion of the flow quantity characteristics, there is caused a dispersion of the quantity of the practically injected and supplied fuel among the respective cylinders.

However, according to the conventional air-fuel ratio feedback control, an oxygen sensor is arranged at the junction of exhaust gas paths of the respective cylinders, the average air-fuel ratio in the respective cylinders is detected based on the oxygen concentration in exhaust gases detected by the oxygen sensor and the control is made to bring this average air-fuel ratio close to the target air-fuel ratio. Accordingly, the dispersion of the flow quantity characteristics among the fuel injection valves of the respective cylinders cannot be corrected, and if there is a dispersion of the flow quantity characteristics, it is impossible to obtain the target air-fuel ratio in the respective cylinders.

More specifically, for example, if the flow quantity of one cylinder is reduced because of clogging of injection holes and the average air-fuel ratio becomes lean, in order to compensate this reduction of the average air-fuel ratio, the fuel supply quantity is uniformly increased in all of the cylinders and the air-fuel ratio in other normal cylinders becomes rich. Accordingly, if there is a dispersion of the flow quantity characteristics in the respective cylinders, the average air-fuel ratio can be feedback-controlled to the target value, but it is impossible to realize the target air-fuel ratio in the respective cylinders. Therefore, if there is brought about a dispersion of the air-fuel ratio in the respective cylinders, the property and state of exhaust gas are worsened, the stability of the engine driving is degraded, and there is a risk of a misfire in a specific cylinder.

The present invention has been completed to solve the above-mentioned problem, and it is an object of the present invention to provide an error-detecting apparatus for detecting a dispersion (error) of fuel supply characteristics in respective cylinders in a fuel supply control system equipped with a function of performing the feedback control of the air-fuel ratio, a learning apparatus for correcting the fuel injection quantity for respective cylinders based on the result of this detection and controlling the air-fuel ratios in the respective cylinders separately to the target air-fuel ratio, and a diagnosis apparatus for diagnosing fuel supply means of the respective cylinders separately on receipt of the detection and learning results.

DISCLOSURE OF THE INVENTION

In accordance with the present invention, in a fuel supply control system of an internal combustion engine in which an engine exhaust gas component is detected in a junction of exhaust gas paths of respective cylinders and an air-fuel feedback correction value is set for correcting the basic fuel supply quantity so that the detected actual air-fuel ratios of the respective cylinders are brought close to the target air-fuel ratio, there is provided an apparatus for detecting errors separately for respective cylinders, which comprises error-detecting fuel supply quantity-setting means for setting an error-detecting fuel supply quantity for detecting errors of supply characteristics of fuel supply means based on said air-fuel ratio feedback correction value, a predetermined value for correcting said air-fuel ratio feedback correction value and a basic fuel supply quantity, error-detecting fuel supply-controlling means for controlling driving of the fuel supply means of specific one cylinder for a predetermined time based on said error-detecting fuel supply quantity, and error quantity-detecting means for detecting quantities of errors of supply characteristics of the fuel supply means of the respective cylinders separately by comparing the air-fuel ratio feedback correction value set while the fuel supply of specific one cylinder is controlled by said error-detecting fuel supply-controlling means, with the air-fuel ratio feedback correction value set while the fuel supply means of all the cylinders are driven and controlled based on the normal fuel supply quantity corresponding to the driving state.

More specifically, when the air-fuel ratio of one specific cylinder is forcibly shifted, the quantity of an error of supply characteristics of the fuel supply means of said specific cylinder where the air-fuel ratio is shifted is detected based on whether or not an expected influence of this shifting is manifested on the air-fuel ratio feedback correction value set based on the average air-fuel ratio of the respective cylinders.

In this apparatus, there is preferably disposed averaging means for averaging the air-fuel ratio feedback correction value set by air-fuel ratio feedback correction value-setting means and performing the comparison with the air-fuel ratio feedback correction value by the error quantity-detecting means based on the averaged value.

Furthermore, there is preferably disposed error quantity detection-allowing means for allowing the driving control of the fuel supply means by the error-detecting fuel supply-controlling means and the sampling of the air-fuel feedback correction value to be compared by the error quantity-detecting means only in the stationary driving state after the passage of a time longer than a predetermined time from the transient driving of the engine.

Furthermore, in accordance with the present invention, there is provided a learning apparatus for learning and correcting the fuel supply quantity separately for respective cylinder based on the results of the detection made by the above-mentioned apparatus for detecting errors separately for respective cylinders, which comprises error quantity-storing means for storing the detected quantity of the error of supply characteristics of each cylinder in correspondence to the fuel supply quantity for each cylinder, correction value-learning and setting means for setting a first correction value for each cylinder based on the quantity of the error of the supply characteristics for increasing or decreasing and correcting the fuel supply quantity only by a certain amount for each cylinder when the absolute value of the quantity of the error of the supply characteristics stored in said error quantity-storing means for each cylinder shows a monotonous decrease in correspondence to an increasing change of the fuel supply quantity in the corresponding cylinder and also setting a second correction value based on the quantity of the error of the supply characteristics for each cylinder for correcting the basic fuel supply quantity of the corresponding cylinder when the quantity of the error of the supply characteristics shows a change other than said monotonous decrease, and fuel supply quantity-correcting means for correcting the fuel supply quantity set by fuel supply quantity-setting means based on the first and second correction values set for each cylinder by the correction value-learning and setting means to set a fuel supply quantity for each cylinder, and effecting the driving control of the fuel supply means by fuel supply-controlling means based on the set fuel supply quantity for each cylinder.

More specifically, when the absolute value of the quantity of the error of the supply characteristics decreases substantially monotonously with increase of the supply fuel quantity, a first correction value for increasing or decreasing and correcting the fuel supply quantity at a constant rate is set, so that the smaller than this first correction value is the fuel supply quantity, a larger correction is made (since the ratio of the quantity increased or decreased and corrected by the first correction quantity to the entire quantity becomes large, a large correction is made), whereby the error quantity showing a monotonous decrease is compensated. Furthermore, if the error quantity shows changes of the characteristics other than the monotonous decrease, the basic fuel supply quantity is corrected at a constant rate by the second correction value, and the error quantity stored according to the fuel supply quantity is decreased substantially evenly.

The apparatus for diagnosing the fuel supply means of respective cylinders separately based on the results of the detection by the apparatus for detecting errors separately for respective cylinders according to the present invention or based on the results of learning and correction by the apparatus for performing learning separately for respective cylinders according to the present invention is constructed to comprise means for judging abnormality for each cylinder, which is disposed so that when the quantity of the error of the supply characteristics in the detected cylinder or the first or second correction value set for each cylinder exceeds a predetermined tolerance limit value, occurrence of abnormality in the corresponding cylinder is judged.

BRIEF DESCRIPTION OF THE DRAWINGS

FIGS. 3-1, 3-2, 3-3, 3-4, 4-1, 4-2, 5-1, 5-2, 6-1, 6-2 and 7 are flow charts illustrating contents of controls in the embodiment shown in FIG. 2.

EMBODIMENTS OF THE INVENTION

Figure 1:
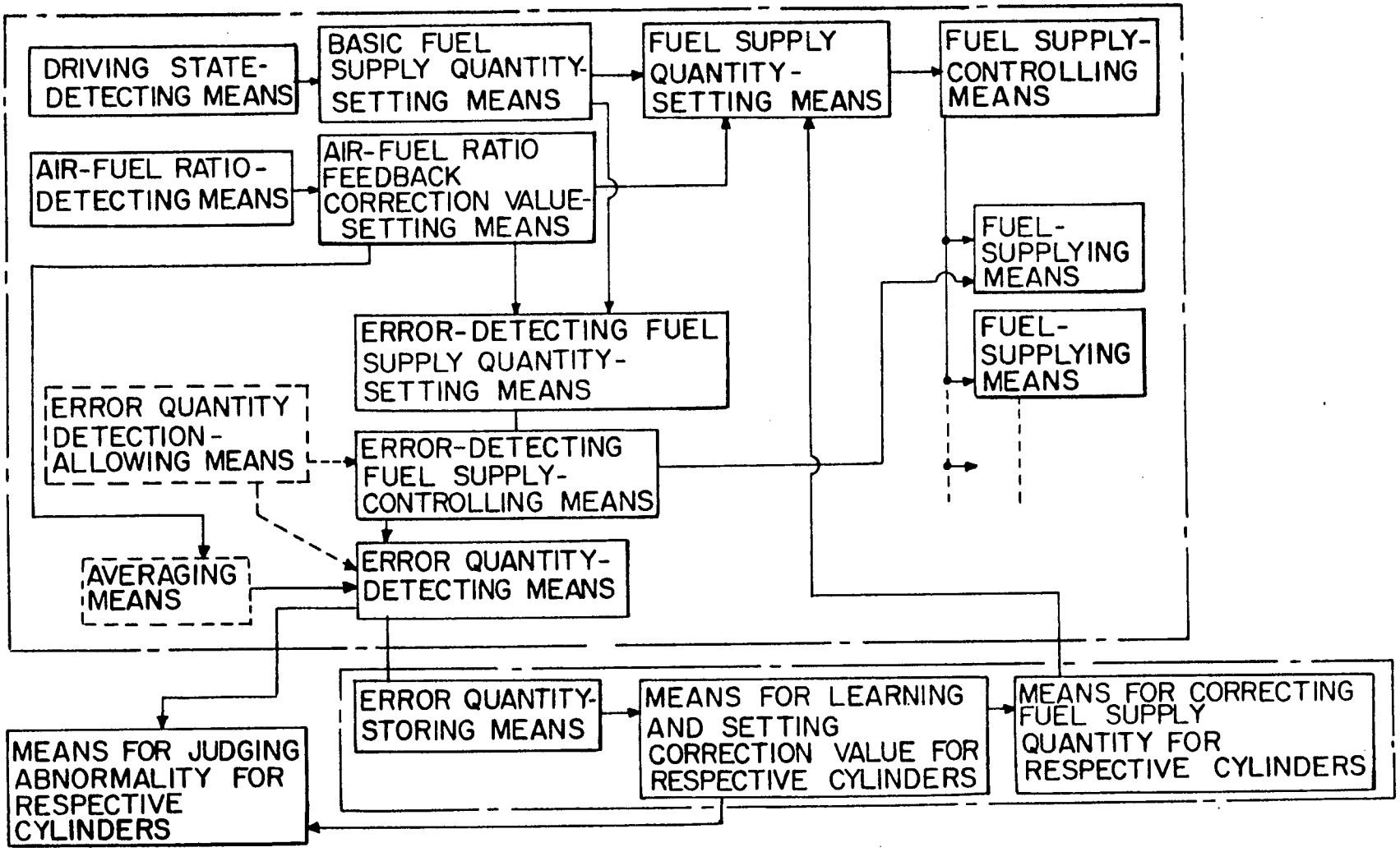
FIG. 1 is a block diagram illustrating the construction of the present invention.

Embodiments of the present invention will now be described. Incidentally, the construction of the present invention is as illustrated in FIG. 1.

Figure 2:
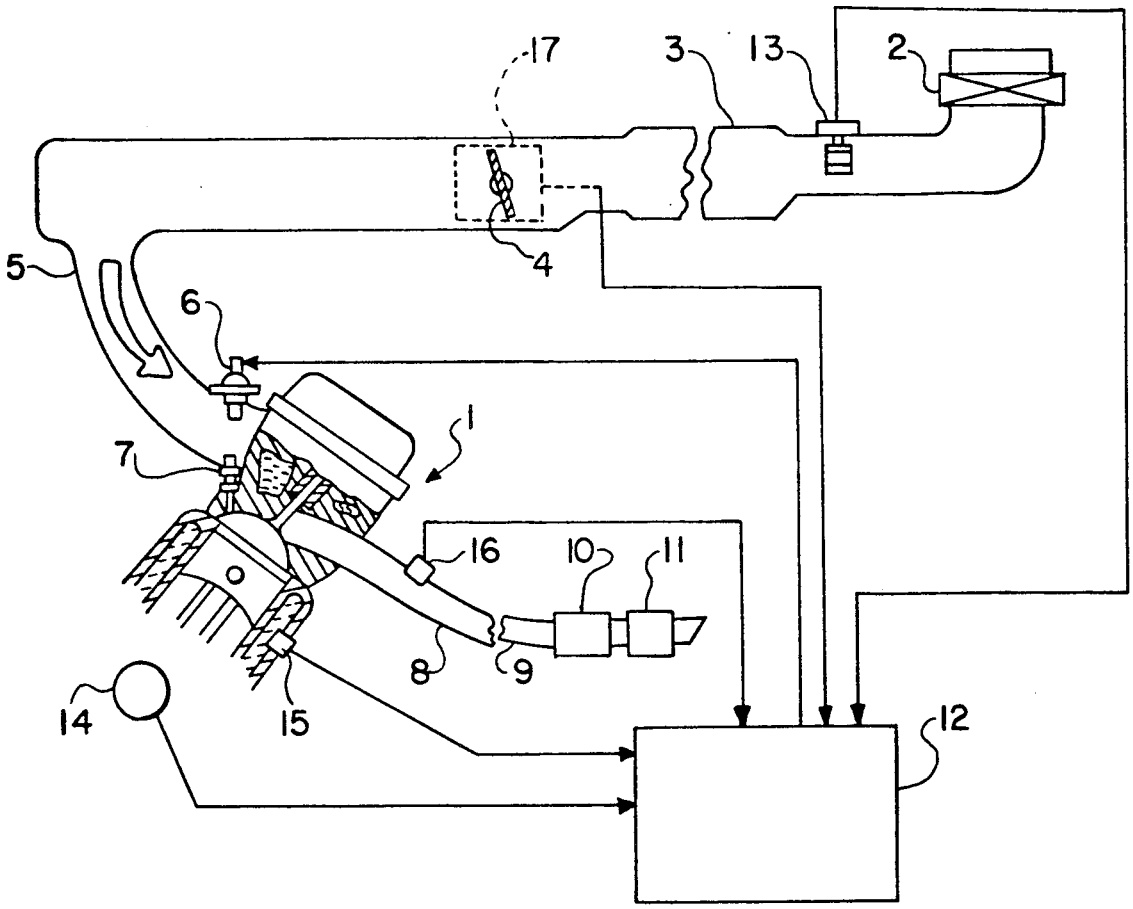
FIG. 2 is a system diagram illustrating one embodiment of the present invention.

Referring to FIG. 2 illustrating the system structure of one embodiment of the present invention, air is sucked into an internal combustion engine 1 from an air cleaner 2 through a suction duct 3, a throttle vale 4 and a suction manifold 5. Fuel injection valves 6 are disposed as fuel supply means for respective cylinders (four cylinders in the present embodiment) in the branch portion of the suction manifold 5. Each fuel injection valve 6 is an electromagnetic fuel injection valve which is opened by actuation of a solenoid and is closed by stopping application of electricity to the solenoid. Namely, the valve 6 is opened by a driving pulse signal emitted from a control unit 12 described hereinafter to inject and supply a fuel fed under pressure from a fuel pump not shown in the drawings and having a pressure adjusted to a predetermined level by a pressure regulator.

An ignition plug 7 is disposed in a combustion chamber of the engine 1 and an air-fuel mixture is ignited and burnt by spark ignition by the ignition plug 7.

Exhaust gas is discharged from the engine 1 through an exhaust manifold 8, an exhaust duct 9, a ternary catalyst 10 and a muffler 11. The ternary catalyst 10 is an exhaust gas-purging device for oxidizing CO and HC in the exhaust gas and reducing $NO_x$ and converting them to harmless substances, and both the conversion efficiencies are at highest levels when the air-fuel mixture is burnt at the theoretical air-fuel ratio.

The control unit 12 is provided with a microcomputer comprising CPU, ROM, RAM, and A/D converter and input and output interfaces. The control unit 12 receives input signals from various sensors, makes computing processings described hereinafter and controls operations of fuel injection valves 7 disposed separately for respective cylinders.

As one of the various sensors, a hot-wire type or flap type air flow meter 13 is arranged in the suction duct 3 to emit a voltage signal corresponding to a sucked air flow quantity Q.

Furthermore, a crank angle sensor 14 is arranged and in case of a four-cylinder engine, a reference angle signal REF is outputted at every 180° and a unit angle signal POS is outputted at every 1° or 2°. By counting the number of unit angle signals POS generated at every frequency of the reference angle signal REF or during a predetermined time, the engine revolution number N can be calculated. Moreover, a water temperature sensor 15 for detecting the cooling water temperature Tw of a water jacket of the engine 1 is disposed.

Still further, an oxygen sensor 16 is disposed as the air-fuel ratio-detecting means in the assembly portion (the assembly portion where exhaust paths of the respective cylinders gather) of the exhaust manifold to detect the air-fuel ratio of the air-fuel mixture sucked in the engine through the oxygen concentration in the exhaust gas. Still in addition, a throttle sensor 17 is attached to the throttle valve 4 to detect the opening degree TVO of the throttle valve 4.

In the present invention, CPU of the microcomputer built in the control unit 12 performs computing processings according to programs on ROM, shown in the flow charts of FIGS. 3 through 7, to control injection of the fuel and perform detection of errors in the fuel injection valves 6 of the respective cylinders, learning separately for the respective cylinders and diagnosis of the respective cylinders. The fuel supply control apparatus in the present embodiment also acts as the apparatus for detecting errors separately for the respective cylinders, the apparatus for performing learning separately for the respective cylinders and the apparatus for performing diagnosis of the respective cylinders.

Incidentally, the basic fuel supply quantity-setting means, air-fuel ratio feedback correction value-setting means, fuel supply quantity-setting means, error-detecting fuel supply quantity-setting means, error-detecting fuel supply-controlling means, error quantity-detecting means, averaging processing means, error quantity detection-allowing means, error quantity-storing means, means for learning and setting the correction value for each cylinder, means for correcting the fuel supply quantity for each cylinder and means for judging abnormality for each cylinder exert their functions according to the programs shown in the flow charts of FIGS. 3 through 7. In the present embodiment, the air flow meter 13, crank angle sensor 14 and the like correspond to the driving state-detecting means.

The computing processings of the microcomputer in the control unit 12 will now be described with reference to the flow charts of FIGS. 3 through 7.

The outlines of various controls will be first described before the detailed description of various computing processings is made with reference to the flow charts of FIGS. 3 through 7. In the present embodiment, when the state of the engine 1 is changed to the stable stationary operation from the transient operation, a predetermined number of the air-fuel ratio feedback correction coefficients LMD used for controlling the air-fuel ratio to the target air-fuel ratio at this stationary operation are sampled, and then, only the air-fuel ratio feedback correction coefficient LMD of specific one cylinder is corrected by a predetermined value Z (1.16 in the present embodiment). A predetermined number of air-fuel ratio feedback correction coefficients LMD used for controlling the air-fuel ratio to the target air-fuel ratio in this fuel-corrected state are sampled.

Based on the actual change of the air-fuel ratio feedback correction coefficient LMD relative to the change estimated by the correction by the predetermined value Z, the quantity of the error of the supply characteristics of the fuel injection valve 6 in the cylinder having the air-fuel ratio feedback correction coefficient LMD corrected by the predetermined value Z is detected for each cylinder, the correction term for correcting the fuel supply quantity Ti for compensating this error is learned separately for the respective cylinder based on the change of the error quantity relative to the change of the fuel supply quantity, and according to this correction term for each cylinder, a fuel supply quantity matched with the corresponding cylinder is set. Furthermore, the diagnosis of the fuel injection valve 6 is performed based on the quantity of the error detected separately for the corresponding cylinder or the correction term learned separately for each cylinder.

The controls will now be described in detail with reference to the flow charts of FIGS. 3 through 7.

Figures 1, 3:
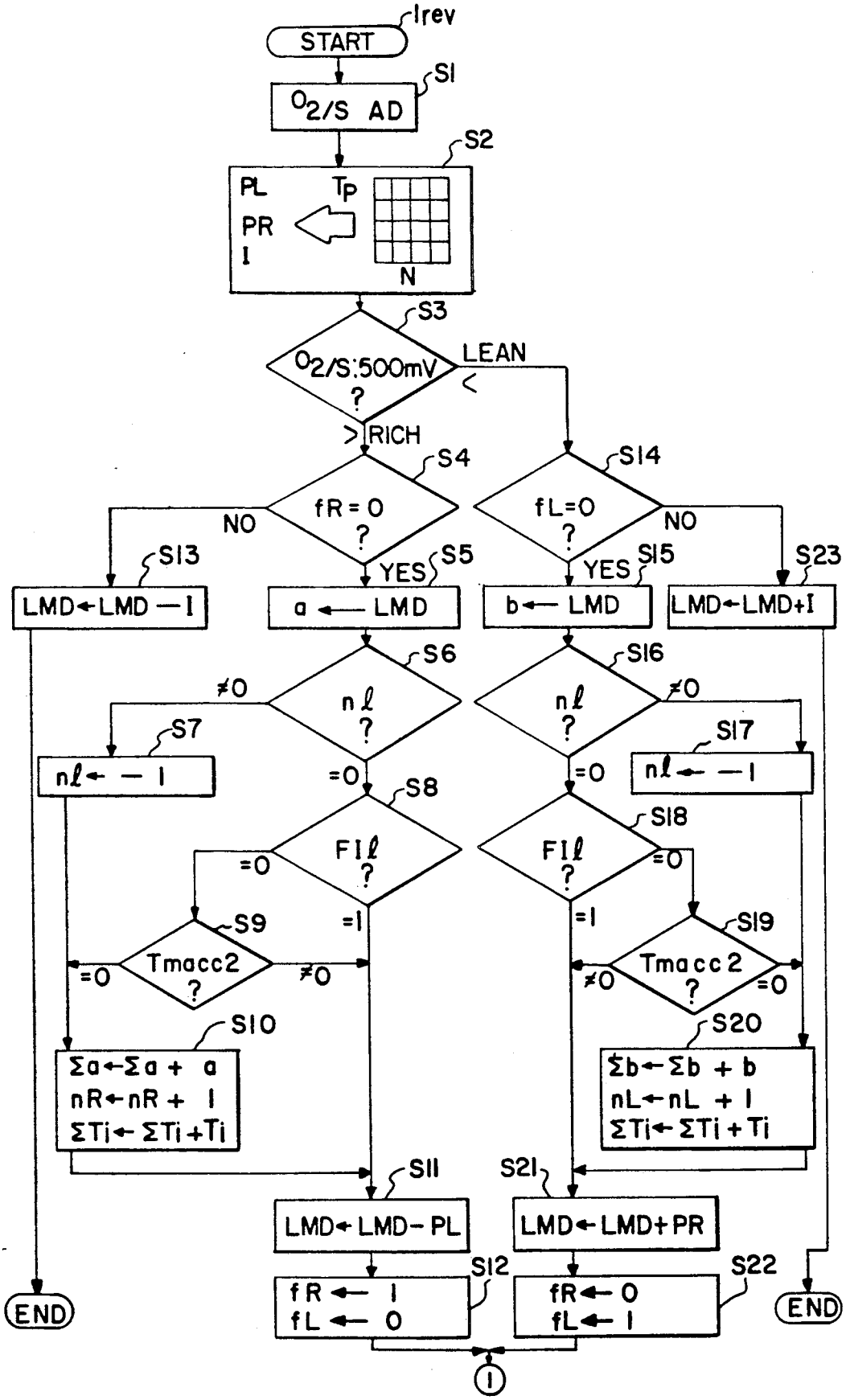
Figures 2, 3:
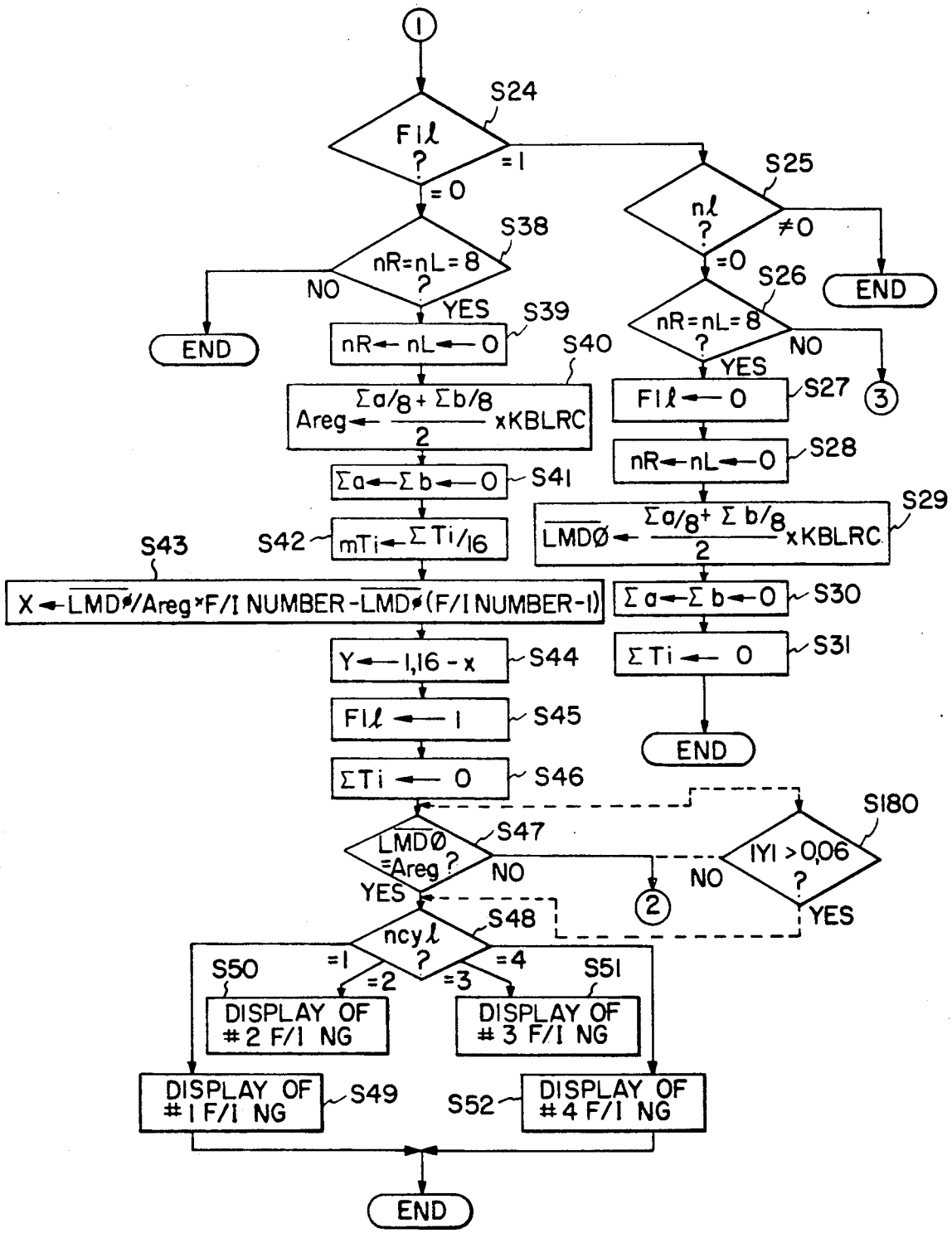
Figure 3:
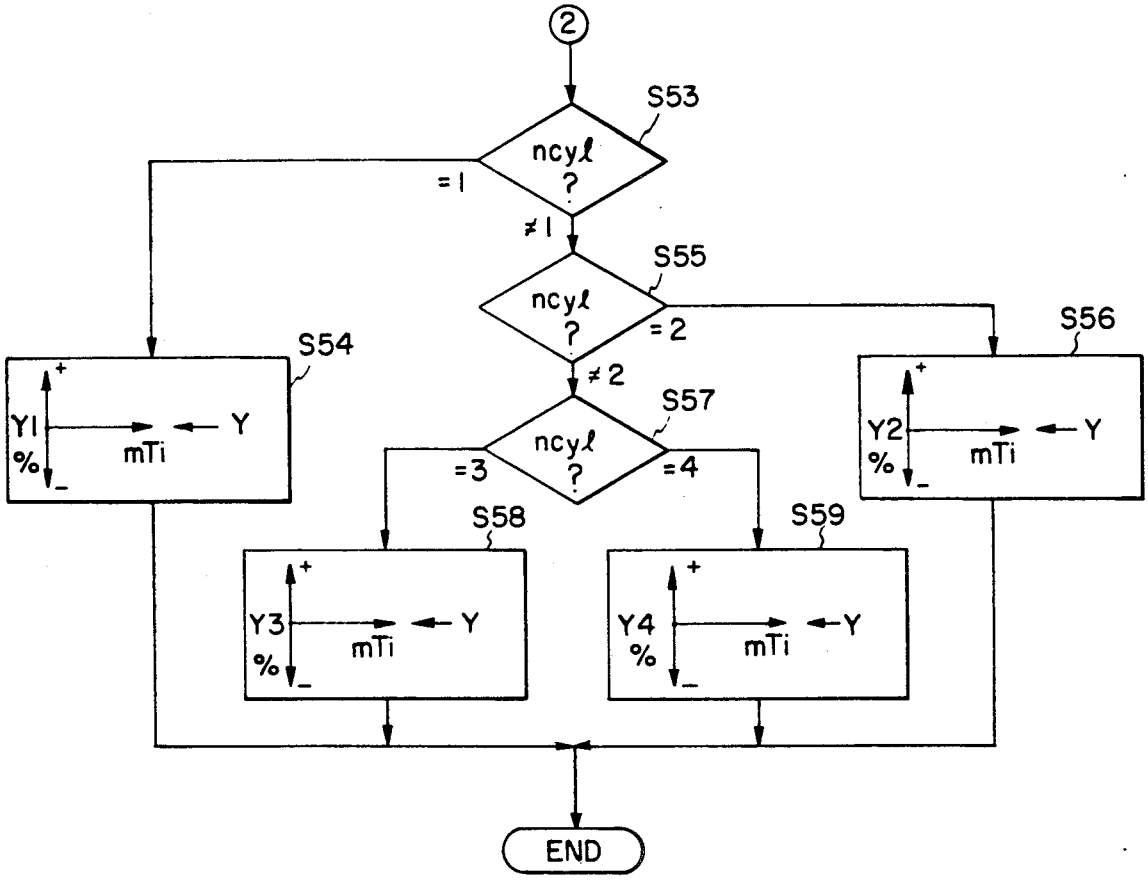

The air-fuel ratio feedback control routine shown in the flow chart of FIG. 3 is worked at every one revolution (1 rev) of the engine 1. In this routine, the proportional-integral control of the air-fuel ratio feedback correction coefficient LMD is performed and simultaneously, the quantity of the error of the fuel supply to each cylinder by the fuel injection valve 6 is detected.

At first, at step 1 (shown as S1 in the drawings; subsequent steps are similarly designated), a detection signal (voltage) outputted according to the oxygen concentration in the exhaust gas from an oxygen sensor ($O_2$/S) 16 is inputted after the AD conversion.

At next step 2, operation data corresponding to the present engine revolution number N and basic fuel injection quantity Tp are retrieved from a map in which operation quantities of the air-fuel ratio feedback correction coefficient LMD (air-fuel ratio feedback correction value) are stored for each of sections formed by dividing the driving state by the engine revolution number N and the basic fuel injection quantity (basic fuel supply quantity) Tp set by another routine described hereinafter.

The air-fuel ratio feedback correction coefficient LMD is used for correction computation of the basic fuel injection quantity Tp to being the air-fuel ratio detected by the oxygen sensor 16 close to the target air-fuel ratio (theoretical air-fuel ratio). In the present embodiment, this setting is accomplished by the proportional-integral control and the operation quantity retrieved from the above-mentioned map comprises a rich control proportional portion PR, a lean control proportional portion PL and an integral portion I.

At step 3, the output of the oxygen sensor 16 obtained by the A/D conversion at step 1 is compared with the slice level (for example, 500 mV) corresponding to the target air-fuel ratio, and it is judged whether the air-fuel ratio of the air-fuel mixture sucked in the engine is richer or leaner than the target air-fuel ratio. Incidentally, since the oxygen sensor 16 detects the oxygen concentration in the exhaust gas in the assembly portion of the exhaust manifold 8, the air-fuel ratio detected by the oxygen sensor 16 is the mean value of the air-fuel ratios of the respective cylinders.

When the output of the oxygen sensor 16 is higher than the slice level and it is judged that the air-fuel ratio is rich, the routine goes into step 4 and the initial rich state-judging flag fR is judged. Since zero is set at this flag fR in the state when the air-fuel ratio is lean, at the initial detection of the rich state, it is judged at this step 4 that the initial rich state-judging flag fR is at zero.

In the case where the flag fR is at 0 and detection of the rich state is the initial detection, the routine goes into step 5, the value of the air-fuel ratio feedback correction coefficient LMD set previously, that is, the air-fuel ratio feedback correction coefficient LMD just before the reversal of from the lean air-fuel ratio to the rich air-fuel ratio, is set at the maximum value (peak value) a.

At next step 6, it is judged whether or not zero is set in normal learning counter nl (see FIG. 8) at which a predetermined value is set at the initial time from the change of from the transient operation to the stationary operation. If the count value of the normal learning counter nl is not zero, the routine goes into step 7 and the count value of the normal learning counter nl is counted down by 1, and at next step 10, the value a set at step 5 is added to the precedent integration value Σa to effect renewal of integration value Σa, and the count value of an initial rich state counter nR is increased by 1 and a newest value Ti of the fuel injection quantity is added to the integrated value ΣTi of the fuel injection quantity to effect renewal of ΣTi.

More specifically, at the initial change of from the transient operation to the stationary operation, a predetermined value is set at the normal learning counter nl, and at every initial detection of the rich state, the count value of the counter nl is counted down by 1 and at every countdown, the maximum value a of the air-fuel ratio feedback correction coefficient LMD and the fuel injection quantity Ti are integrated and the count value of the initial rich state counter nR is increased by 1. Data collected during the countdown of the normal learning counter nl are compared with the data during the period of learning of the fuel injection valve 6 and the quantity of the error of the fuel supply to the fuel injection valve 6 is detected.

Incidentally, as described hereinafter, at the initial detection of the lean state, the minimum value b of the air-fuel ratio feedback correction coefficient LMD and the fuel injection quantity Ti are integrated, and the count value of the initial lean counter nL is increased by 1.

On the other hand, when it is judged at step 6 that the normal learning counter nl is at zero, the routine goes into step 8, F/I learning flag FIl for judging the learning period of the fuel injection valve (F/I) 6 is judged. In the case where the F/I learning flag FIl is at zero and the time is during the period of learning the fuel injection valve 6 for each cylinder, the routine goes into step 9, and it is judged whether or not zero is set at a timer Tmacc2 (see FIG. 8) for measuring the period of inhibition of F/I learning (data sampling) from the point when the F/I learning flag FIl is 0.

In the case where the timer Tmacc2 is not at zero and a time exceeding the predetermined time does not elapse from the point at which the F/I learning flag FIl has become zero, the routine goes into step 11 while skipping step 10. However, in the case where the timer Tmacc2 is at zero and a time exceeding the predetermined time elapses from the point at which the F/I learning flag FIl has become zero, the routine goes into step 10, and the maximum value a of LMD and the fuel injection quantity Ti are integrated and simultaneously, the count value of the initial rich counter nR is increased by 1.

Namely, before the normal learning counter nl becomes zero and while the F/I learning flag FIl is at zero and the timer Tmacc2 is at zero, Σa and ΣTi are computed and the count value of nR is increased by 1. Only when the normal learning counter nl is at zero and the F/I learning flag FIl is at 1 and when the normal learning counter nl is at zero and the timer Tmacc2 is not at zero, integration of Σa and ΣTi and the countup of nR are not performed. This control is commonly conducted with respect to the integration of Σb and ΣTi and the countup of nL at the initial lean detection, as described hereinafter.

When the F/I learning flag FIl becomes zero, as described hereinafter, only the air-fuel ratio feedback correction coefficient LMD of specific one cylinder is corrected by the predetermined value Z, and the subsequent change of the air-fuel ratio feedback correction coefficient is monitored, and the time required for the air-fuel ratio feedback correction coefficient LMD to be settled at the value corresponding to the above-mentioned correction is detected by the timer Tmacc2.

At step 11, the lean control proportional portion PL retrieved at step 2 is subtracted from the precedent air-fuel ratio feedback correction coefficient LMD, and the obtained result is set as the new air-fuel ratio feedback correction coefficient LMD, and the fuel supply quantity is decreased and corrected and the rich state of the air-fuel ratio is compensated.

After the proportional control of the air-fuel ratio feedback correction coefficient LMD by the lean control proportional portion PL, 1 is set at the initial rich state-judging flag fR at step 12, and zero is set at the initial lean state-judging flag fR.

While the rich state of the air-fuel ratio is continued, it is judged at step 4 that the initial rich state-judging flag fR is at 1, and the routine goes into step 13.

At step 13, the integral proportion I retrieved at step 2 is subtracted from the precedent value of the air-fuel ratio feedback correction coefficient LMD and the obtained result is newly set as the air-fuel ratio feedback correction coefficient LMD. Accordingly, at step 13, the air-fuel ratio feedback correction coefficient LMD is gradually decreased by the integral portion I at every one revolution of the engine 1 until the rich state of the air-fuel ratio is compensated.

By this decrease of the air-fuel ratio feedback correction coefficient LMD by the integral control, the rich state of the air-fuel ratio is compensated, and when it is judged at step 3 that the output of the oxygen sensor 16 is lower than the slice level and the air-fuel ratio is lean, the routine goes into step 14 and the judgement of the initial lean state-judging flap fL is conducted.

In the case where zero is set at the initial lean state-judging flag 14 at step 12 where the air-fuel ratio is lean, if the detection is the initial detection of the lean state, the judgement of fL=0 is made at step 14.

If the detection is the initial detection of the lean state in case of fL=0, the routine goes into step 15 and the air-fuel ratio feedback correction coefficient LMD, that is, the air-fuel ratio feedback correction coefficient LMD just before the reversal of from the rich air-fuel ratio to the lean air-fuel ratio, is set at the minimum value (peak value) b.

At next step 16, it is judged whether or not the count value of the normal learning counter nl (see FIG. 8) is zero, in the same manner as described above with respect to the initial detection of the rich state. When the count value of the normal learning counter nl is not zero, the routine goes into step 17 and the count value of the normal learning counter nl is decreased by 1. At next step 20, b set at step 15 is added to the integration value Σb to effect renewal of the integration value of Σb, and simultaneously, the count value of the lean state-detecting counter nl is increased by 1 and the newest value Ti is added to the integration value ΣTi of the fuel injection quantity Ti to renew ΣTi.

On the other hand, when it is judged at step 16 that the count value of the normal learning counter nl is zero, the routine goes into step 18, and the judgement of the F/I learning flag FIl for judging the learning period of the fuel injection valve (F/I) 6 is made. If the F/I learning flag FIl is at 0 and the time is the period of learning the fuel injection valve 6 for each cylinder, the routine goes into step 19, and it is judged whether or not the timer Tmacc2 (see FIG. 8) for measuring the period of inhibition of the F/I learning (data sampling) from the point at which the F/I learning flag FIl becomes zero is at zero.

When the timer Tmacc2 is not at zero and a time exceeding the predetermined times does not elapse from the point at which the F/I learning flag FLl has become zero, the routine goes into step 21 while skipping step 20, but when the timer Tmacc2 is at zero and a time exceeding the predetermined time elapses from the point at which the F/I learning flag FIl has became zero, the routine goes into step 20 and the integration of the minimum value b of LMD and the fuel injection quantity Ti is carried out and simultaneously, the count value of the initial lean counter nL is increased by 1.

By the above-mentioned computing processings, when the count value of the normal learning counter nl is not zero, at every reversal of the air-fuel ratio, data of the maximum and minimum values a and b of the air-fuel ratio feedback correction coefficient LMD and data of the fuel injection quantity Ti are sampled, and even when the count value of the normal learning counter nl is zero, if the F/I learning flag FIl is at 0 and a time exceeding the predetermined time elapses from the point where the F/I learning flag FI has become 0, data of the maximum and minimum values a and b of the air-fuel ratio feedback correction coefficient LMD and data of the fuel injection quantity Ti are similarly sampled and the count values of the rich/lean reversal frequency counters nR and nL are increased.

The data sampled when the count value of the normal learning counter nl is not zero are data at the normal fuel control, and the data sampled when the F/I learning flag FIl is at zero are data at the learning of the fuel injection valve 6 of each cylinder (only the air-fuel ratio feedback correction coefficient LMD of one specific cylinder is corrected by the predetermined value Z to control the fuel supply).

At step 21, the rich control proportional portion PR retrieved at step 2 is added to the precedent air-fuel ratio feedback correction coefficient LMD and the obtained result is set as the new air-fuel ratio feedback correction coefficient LMD, whereby the fuel supply quantity Ti is increased and corrected and the lean state of the air-fuel ratio is compensated.

After the proportional control of the air-fuel ratio feedback correction coefficient LMD by the rich control proportional portion PR, zero is set at the initial rich state-judging flag fR at step 22, while 1 is set at the initial lean state-judging flag fL.

When the lean state of the air-fuel ratio is continued, it is judged at step 15 that the initial lean state-judging flag fL is at 1, and the routine goes into step 23.

At step 23, the integral portion I retrieved at step 2 is added to the precedent value of the air-fuel ratio feedback correction coefficient LMD, and the obtained result is set as the new air-fuel ratio feedback correction coefficient LMD. Accordingly, the air-fuel ratio feedback correction coefficient LMD is gradually increased by the integral portion I at every one revolution of the engine 1 at this step 23 until the lean state of the air-fuel ratio is dissolved.

At the initial detection of the rich-lean state, the following computing processings are carried out at step 24 and subsequent steps.

At step 24, the state of the F/I learning flag FIl is judged, and when it is judged that the F/I learning flag FIl is at 1, that is, when learning of the fuel injection value of one specific cylinder is not conducted, the routine goes into step 25. At step 25, the state of the normal learning counter nl is judged, and when the normal learning counter nl is not at zero, the routine is ended but when the normal learning counter nl is at zero, the routine goes into step 26.

At step 26, it is judged whether or not the count value of each of the counters nR and nL for counting the frequency of the rich-lean reversal is 8, and when it is judged that the count number of each of nR and nL is 8, in order to show that the reversal frequency of the air-fuel ratio during the countdown of the normal learning counter nl from the predetermined value becomes the prescribed number, the routine goes into step 27 onward and the air-fuel ratio feedback correction coefficient LMD before the F/I learning is learned.

More specifically, in the present embodiment, if a predetermined time Tmacc lapses from the point of the change of from the transient operation to the stationary operation, from this point, the countdown of the normal learning counter nl from a predetermined value is started, and data of peak values a and b of the air-fuel ratio feedback correction coefficient LMD and the fuel injection quantity Ti are collected until the count value of the normal learning counter nl is reduced to zero. These data are compared with data collected at subsequent learning of the fuel injection valves 6 of respective cylinders, and errors of the supply characteristics of the fuel injection valves 6 are detected based on the results of the comparison. If the count value of each of nR and nL is 8, it indicates that collection of data to the point when the count value of the normal learning counter nl is reduced to zero is completed.

Since the data for initiating learning of fuel injection valves 6 for respective cylinders have been collected, zero is set at the F/I learning flag FIl at step 27, and at subsequent step 28, zero is reset at nR and nL, the count values of which have been increased while the count value of the normal learning counter nl has been decreased to zero.

At step 29, the mean value $(\Sigma a/8+\Sigma b/8)/2$ of the median values of the air-fuel ratio correction coefficient LMD is determined from $\Sigma a$ and $\Sigma b$ sampled until the count value of the normal learning counter nl is reduced to zero, and the value obtained by multiplying this mean value by the air-fuel ratio learning correction coefficient KBLRC learned for each operation state is designated as the initial value $\overline{LMD}\phi$ (value before F/I learning) of the air-fuel ratio feedback correction coefficient LMD.

The air-fuel ratio learning correction coefficient KBLRC is learned so that the base air-fuel ratio obtained without the air-fuel ratio feedback correction coefficient LMD in the case other than the case where the control concerning the learning of the fuel injection valves 6 for respective cylinders becomes the target air-fuel ratio. The air-fuel ratio learning correction coefficient KBLRC is learned and stored for each driving state defined by the basic fuel injection quantity Tp and the engine revolution number N.

At next step 30, $\Sigma a$ and $\Sigma b$ sampled until the count value of the normal learning counter nl is decreased to zero are reset at zero, and at next step 31, $\Sigma Ti$ is reset at zero.

On the other hand, it is judged at step 26 that the count numbers of nR and nL are not 8, it means the normal control state where the computing processing concerning the learning of the fuel injection valves 6 for respective cylinders is not carried out, and therefore, learning and setting of the air-fuel ratio learning correction coefficient KBLRC are conducted at step 32 onward.

At step 32, it is judged whether or not the count numbers of nR and nL are zero, and if it is judged that they are not zero, the present routine is ended. If it is judged that each of them is zero, the routine goes into step 33 and the air-fuel ratio learning correction coefficient KBLRC corresponding to the present operation state is retrieved from a map in which the air-fuel ratio learning collection coefficient KBLRC is stored in correspondence to the basic fuel injection quantity Tp and the engine revolution number N.

At next step 34, the air-fuel ratio learning correction coefficient KBLRC corresponding to the present operation state is determined by calculating the weighted mean of the median value $(a+b)/2$ of the correction coefficient LMD obtained from newest values of peak values a and b of the air-fuel ratio feedback correction coefficient LMD and the air-fuel ratio learning correction coefficient KBLRC retrieved from the map based on a predetermined value M according to the following formula:

$$KBLRC \leftarrow \frac{a+b}{2}(1-M) + KBLRC \times M$$

At step 35, the map data are rewritten by using the new air-fuel ratio learning correction coefficient KBLRC determined at step 34 as the new data of the correction coefficient KBLRC stored in correspondence to the basic fuel injection quantity Tp and the engine revolution number N.

On the other hand, when it is judged at step 24 that the F/I learning flag FIl is at zero, this indicates the state where the learning of the fuel injection valve 6 of each cylinder is carried out, and in order to detect an error of the supply characteristics of the fuel injection valve 6 of one specific cylinder, as described hereinafter, only the air-fuel ratio feedback correction coefficient of this one specific cylinder is corrected by the predetermined value Z. Also in this state, data of $\Sigma a$, $\Sigma b$ and $\Sigma Ti$ are collected as in the case where the count value of the normal learning center nl is not zero, and simultaneously, the count values of nR and nL counting the frequency of the reversal of the air-fuel ratio are increased from zero.

Accordingly, at step 38, it is judged whether or not the count values of nR and nL are 8, and it is thus judged whether or not the air-fuel ratio is reversed at a frequency exceeding the predetermined frequency from the start of the learning of the fuel injection valve 6. If it is judged that the count values of nR and nL are not 8, since the number of data collected at the learning of the fuel injection 6 is small and learning at a high precision cannot be performed, the present routine is ended. On the other hand, in the case where the count values of nR and nL are 8, since a predetermined number of data have been collected, the routine goes into step 39 and the error of the supply characteristics in the fuel injection valve 6 of the cylinder in which the fuel correction (correction of LMD) has been made is detected.

At step 39, the count valves of nR and nL where the countup is effected in the state where the F/I learning flag FIl is at zero are reset at zero.

At step 40, the correction coefficient Areg used for controlling the actual air-fuel ratio to the target air-fuel ratio when the F/I learning flag FIl is at zero and only the air-fuel ratio feedback correction coefficient LMD of one specific cylinder is corrected by the predetermined value Z is computed according to the following formula:

$$Areg \leftarrow \frac{\Sigma a/8 + \Sigma b/8}{2} \times KBLRC$$

Namely, this correction coefficient Areg is equivalent to $LMD\phi$ used for controlling the air-fuel ratio when the count value of the normal learning counter nl is not zero, and is the correction coefficient for the basic fuel injection quality Tp, which becomes necessary for controlling the average air-fuel ratio in the respective cylinders to the target air-fuel ratio as the result of the correction of only the air-fuel ratio feedback correction coefficient LMD of one specific cylinder by the predetermined value Z.

At next step 41, data of $\Sigma a$ and $\Sigma b$ for the learning of the fuel injection valve 6, which have been used for the computation of step 40, are reset at zero.

At step 42, the integration value $\Sigma Ti$ of the fuel injection quantity Ti obtained by integration made simultaneously with the integration of Σa and Σb is divided by the sample number, 16, and the obtained value is set as the mean value mTi at the F/I learning.

At next step 43, the above-mentioned predetermined value Z is calculated back from the result of the air-fuel ratio feedback correction obtained at the correction of only the air-fuel ratio feedback correction coefficient LMD of one specific cylinder by the predetermined value Z according to the following formula:

$$X \leftarrow \overline{LMD}\phi[Areg \times F/I\ number - \overline{LMD}\phi(F/I\ number - 1)]$$

Namely, in the present embodiment, in detecting an error of the supply characteristics of each fuel injection valve 6, only the air-fuel feedback correction coefficient LMD of one specific cylinder is multiplied by the predetermined value (1.16) and the fuel injection quantity is computed, and only in the above-mentioned one specific cylinder, the fuel supply is controlled under the fuel injection quantity Ti corrected by the above-mentioned predetermined value and the error of the supply characteristics of this fuel injection valve 6 is detected according to whether or not the result of this control is manifested on the feedback correction control of the air-fuel ratio as expected. The formula of calculation of X (the value reckoned back from the predetermined value Z) is a derived in the following manner.

Supposed that if the fuel supply is corrected only in one specific cylinder, the air-fuel ratio feedback control is effected separately in this cylinder, when the correction coefficient becomes LMDϕ/Z relatively to the air-fuel ratio correction coefficient LMDϕ before the correction of the fuel supply, the correction of the air-fuel ratio feedback correction coefficient LMD by the predetermined value Z is cancelled and the air-fuel ratio should be returned to the target air-fuel ratio. On the other hand, in connection with other cylinders where the air-fuel ratio feedback correction coefficient LMD is not corrected by the predetermined value Z, since the fuel supply is not corrected, even if the feedback correction is performed separately in each of these cylinders, the air-fuel ratio correction coefficient LMDϕ is not changed. Since the air-fuel ratio feedback correction based on the detection by the oxygen sensor 16 is to control the mean value of the air-fuel ratios in all of cylinders to the target air-fuel ratio, the air-fuel ratio correction coefficient $\overline{LMD}$ (the correction coefficient obtained by multiplying the air-fuel ratio feedback correction coefficient LMD by the air-fuel ratio learning correction coefficient KBLRC) obtained by correcting the air-fuel ratio feedback correction coefficient LMD only in one specific cylinder should be obtained as the mean value in the respective cylinders.

Accordingly, the air-fuel ratio correction coefficient $\overline{LMD}$ necessary for controlling the air-fuel ratio to the target air-fuel ratio when the fuel supply only in one specific cylinder is corrected by the predetermined value Z is expressed as follows:

$$\overline{LMD} \leftarrow \frac{\overline{LMD}\phi/Z + LMD\phi(F/I\ number - 1)}{F/I\ number}$$

Since the air-fuel ratio correction coefficient necessary for controlling the air-fuel ratio to the target air-fuel ratio when the air-fuel ratio feedback correction coefficient LMD is corrected only in one specific cylinder by the predetermined value Z is obtained as Areg at step 40, the predetermined value Z can be reckoned backward by substituting this Areg for $\overline{LMD}$ of the above-mentioned formula, and this back calculation formula is the above-mentioned formula of the calculation of X. If the fuel injection valve 6 of the cylinder where the correction has been made by the predetermined value Z is normal, the predetermined value Z should be substantially equal to the valve X obtained by calculating the predetermined value Z backward according to the above-mentioned formula. If a difference is brought about between both the values, this indicates that the fuel is not injected at a high precision in an amount corresponding to the correction by the predetermined value Z from the fuel injection valve 6 of the cylinder where the fuel supply has been corrected and the error of the supply characteristics in this cylinder is detected according to the above-mentioned difference.

Accordingly, at this step 44, the difference Y[←1.16(Z)−X] between X computed at step 43 and the predetermined value Z (1.16 in the present embodiment) practically used for the correction of the fuel injection quantity Ti (air-fuel feedback correction coefficient LMD) is computed. This Y corresponds to the error rate (quantity) of the fuel injection value 6 of the learned cylinder. When the fuel injection valve 6 injects the fuel only in an amount smaller than the predetermined quantity, since X becomes smaller than the predetermined value Z, in this case, Y is a positive value, and although Y is the error rate, Y can be regarded as the value to be corrected in this cylinder.

Since Y corresponding to the error of the supply characteristics in the cylinder where the fuel supply has been corrected is computed at step 44, at next step 45, 1 is set at the F/I learning flag FII and at next step 46, ΣTi is reset at zero.

Furthermore, at step 47, it is judged whether or not the air-fuel ratio correction coefficient Areg determined at step 40 is substantially equal to the initial value $\overline{LMD}\phi$ determined in the normal fuel control state before the learning of the fuel injection valve 6. Since the air-fuel ratio correction coefficient Areg is the data obtained when the fuel supply in one specific cylinder is corrected, normally, the air-fuel ratio correction coefficient Areg changes relatively to the initial value LMDϕ, and in the case where the air-fuel ratio correction coefficient is not changed even if the fuel supply is corrected in one specific cylinder, it is presumed that driving control of the fuel injection valve 6 in this cylinder is impossible by wire breaking or short circuit in the circuit.

Accordingly, if it is judged at step 47 that $\overline{LMD}\phi$ is equal to Areg, the fuel injection valve 6 of the cylinder in which the fuel supply is corrected is abnormal, and therefore, at step 48, the number ncyl of the corrected cylinder where the F/I where the F/I learning has been made is judged, and at steps 49 through 52, the abnormal (NG) stage of the fuel injection valve 6 of the corrected cylinder is displayed, for example, on a dashboard of a vehicle. If the cylinder in which control is impossible is thus displayed, the maintenance such as the exchange of the fuel injection valve 6 can be promptly accomplished, and continuous use of the uncontrollable fuel injection valve 6 can be prevented.

On the other hand, it is judged at step 47 that $\overline{LMD}\phi$ is not equal to Areg, even though there is an error of the supply characteristics, it is impossible to directly judge the abnormality of the fuel injection valve 6. Accordingly, at steps 53 through 59, the error rate Y of the supply characteristics now detected is stored separately for the respective cylinders in correspondence to the fuel injection quantity mTi.

At step 53, it is judged whether or not ncyl at which the number of the cylinder where the fuel supply is corrected for the F/I learning is 1, and if ncyl is 1 and the learning of the fuel injection valve 6 of #1 cylinder is carried out, the error rate Y determined at step 44 is stored as the data of the map for storing the error rate Y of #1 cylinder in correspondence to the average fuel injection quantity mTi determined at step 42.

If it is judged at step 53 that ncyl is not 1, it is judged at step 55 whether or not ncyl is 2. If ncyl is 2, the routine goes into step 56 and the error rate Y determined at step 44 is stored as the data of the map storing the error rate Y2 of #2 cylinder in correspondence to the average fuel injection quantity mTi.

Furthermore, if it is judged at step 55 that ncyl is not 2, it is judged at step 57 whether ncyl is 3 or 4. When ncyl is 3, at step 58, Y is stored in the map of the error rate Y3 of #3 cylinder. If ncyl is 4, at step 59, Y is stored in the map of the error rate Y4 of #4 cylinder.

If error rates detected separately for the respective cylinders are thus stored in correspondence to the fuel injection quantity mTi separately for the respective cylinders, it is possible to judge how the error rates Y1 through Y4 of the fuel injection valves 6 of the respective cylinders change according to the change of the fuel injection quantity Ti, and it is possible to judge what corrections should be made to the fuel injection quantities Ti by computation so as to perform desired fuel supply controls in the respective cylinders based on the result of the above judgement. Furthermore, the result of the above judgement can be used as the material for the diagnosis of the abnormality of the fuel injection valve 6 of each cylinder.

Figures 3, 4:
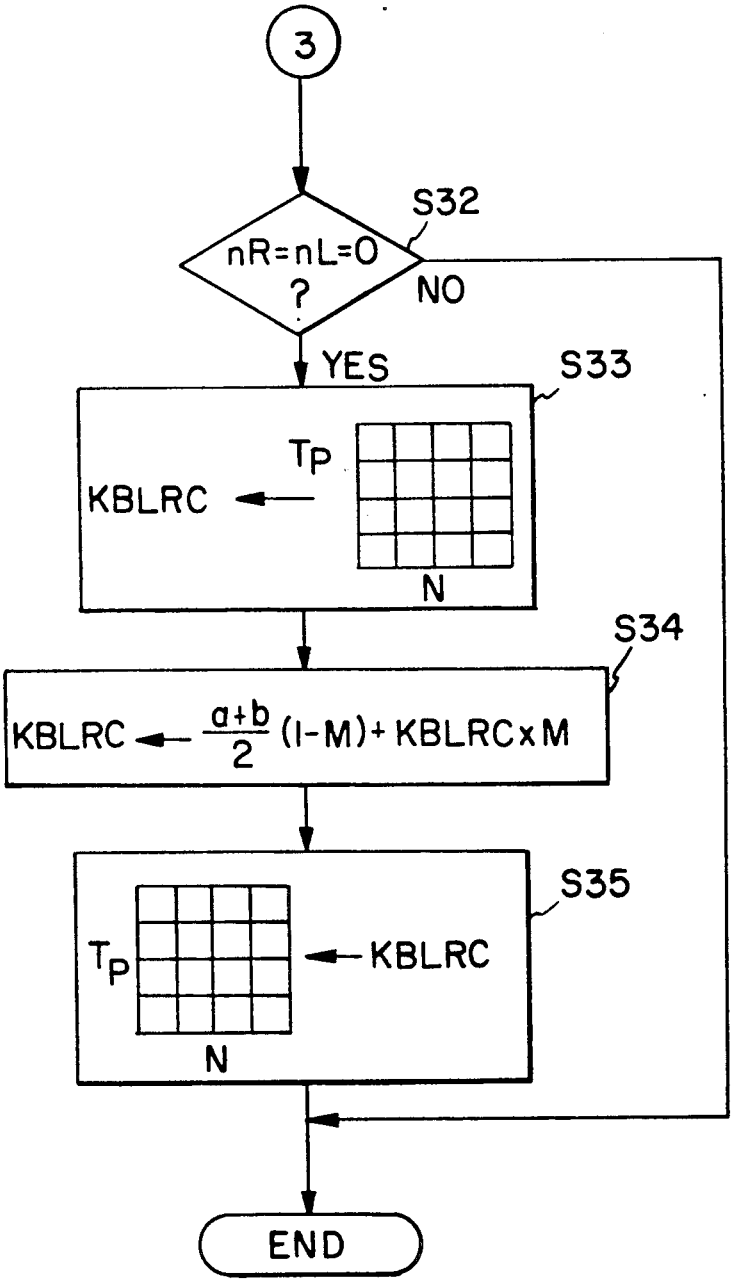
Figures 1, 4:
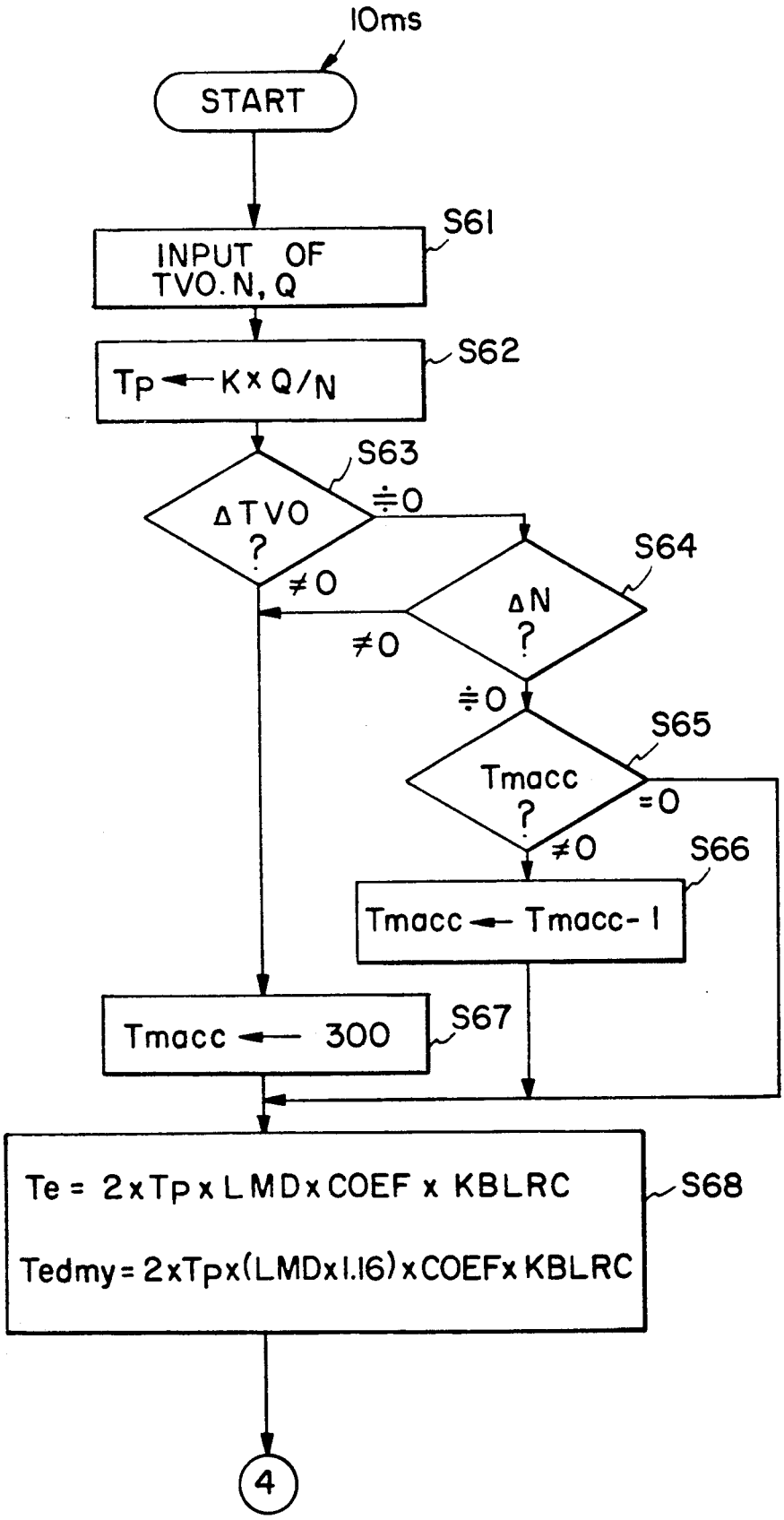
Figures 2, 4:
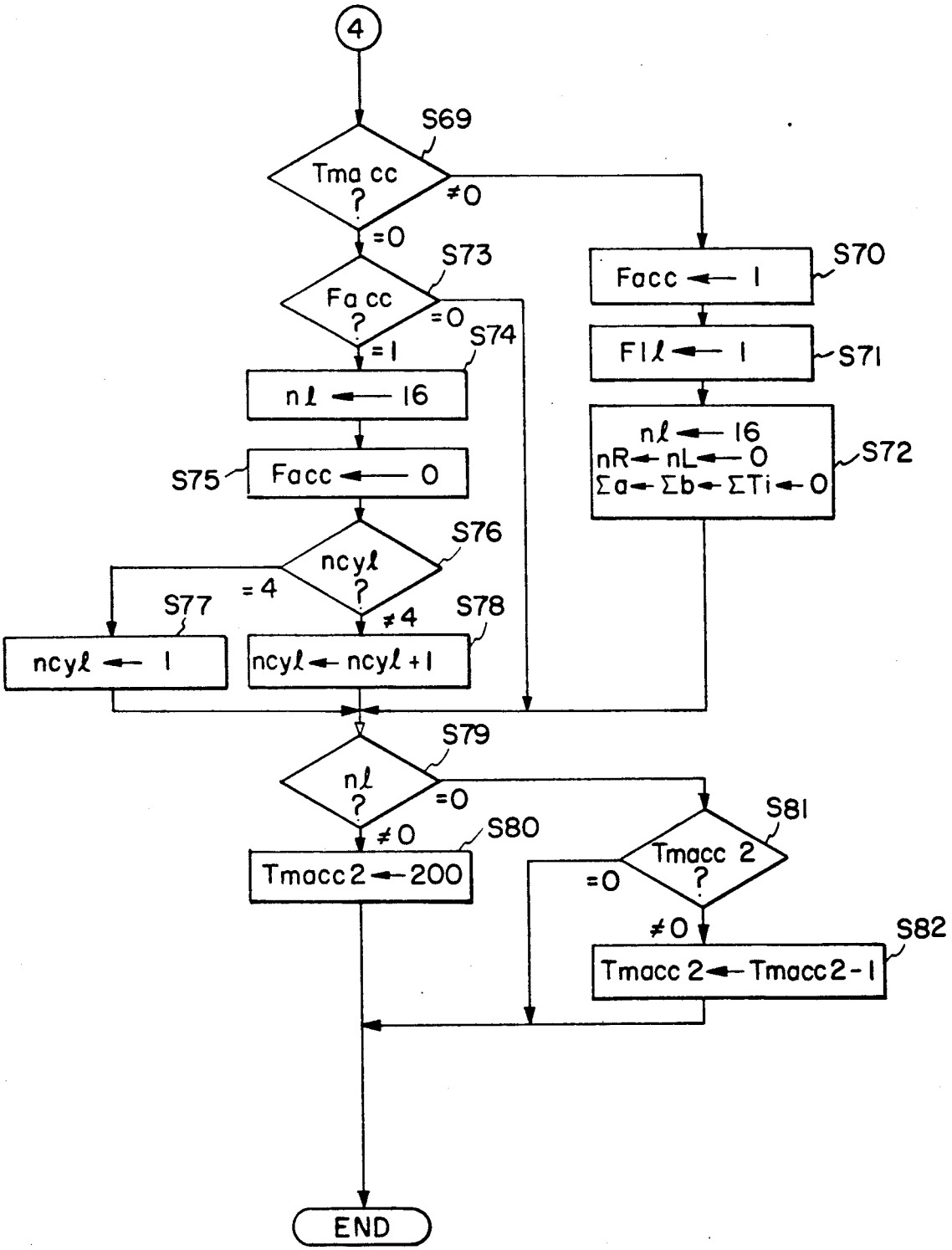

The routine shown in the flow charge of FIG. 4 is a routine of computing the fuel injection quantity, which is worked at every 10 ms.

At step 61, the opening degree TVO of the throttle valve 4 detected by the throttle sensor 17, the engine revolution number N calculated based on the detection signal from the crank angle sensor 14 and the sucked air flow rate detected by the air flow meter 13 are inputted.

At next step 61, the basic fuel injection quantity [basic fuel supply quantity Tp ($\leftarrow K \times Q/N$; K is a constant)] is calculated from the engine revolution number N and sucked air flow quantity Q inputted at step 61.

The basic fuel injection quantity Tp shows how long the fuel injection valve 6 should be opened for injecting and supplying the fuel in an amount necessary for obtaining the theoretical air-fuel ratio according to the present quantity of air sucked in the cylinder, and the constant K used for the computation is set based on the relation between the opening time of the fuel injection valve 6 and the actual quantity of the injected fuel.

At step 63, it is judged whether or not the opening degree change rate ΔTVO per unit time, determined as the difference between the throttle valve opening degree TVO inputted as step 61 and the input value at the precedent run of the present routine, is substantially zero.

When the opening degree change rate ΔTVO is substantially zero and the opening degree of the throttle valve 4 is substantially constant, it is judged at step 64 whether or not the change rate ΔN of the engine revolution number N determined in the same manner as in case of ΔTVO is substantially zero.

If it is judged at this step 64 that the change rate ΔN is substantially zero, since the opening degree TVO of the throttle valve 4 is substantially constant and the engine revolution number N is substantially constant, the engine 1 is regarded as being in the stationary driving state, and the routine goes into step 65.

On the other hand, at least one of ΔTVO and ΔN is not substantially zero but varies, the engine 1 is regarded as being in the transient driving state and the routine goes into step 67.

At step 67, a predetermined value (300) is set at a time Tmacc for measuring the time elapsing from the point of the change to the stationary driving state from the transient driving state. At the change of the stationary driving state from the transient state, it is judged at step 65 whether or not the timer Tmacc is at zero, and if it if judged that the timer Tmacc is not at zero, the routine goes into step 66 and the timer Tmacc is counted down by 1.

It is after a predetermined time corresponding to the predetermined time set at step 67 and the working frequency of the present routine elapses from the point of the judgement of the stationary driving of the engine 1 based on ΔTVO and ΔN that the timer Tmacc is at zero. Even when the stationary driving of the engine 1 is judged based on ΔTVO and ΔN, in order to eliminate influences of variations of the air-fuel ratio at the transient driving before the value of the timer Tmacc becomes 1, F/I learning is carried out only at the stable stationary driving after the lapse of a predetermined time from the transient driving at which the value of the timer Tmacc becomes 1 (step 69).

After step 68, an effective injection quantity Te for controlling the normal injection commonly in the respective cylinders and an effective injection quantity Tedmy for learning the fuel injection valve 6 (for detection of the error) are computed according to the following formulae:

$$Te \leftarrow 2 \times Tp \times LMD \times COEF \times KBLRC, \text{ and}$$

$$Tedmy \leftarrow 2 \times Tp \times (LMD \times 1.16) \times COEF \times KBLRC$$

wherein Tp represents the basic fuel injection quantity computed at step 62 of the present routine, LMD represents the air-fuel ratio feedback correction coefficient computed in the routine shown in the flow chart of FIG. 3, KBLRC represents the air-fuel ratio learning correction coefficient learnt in the routine shown in FIG. 3, and COEF represents various correction coefficients set based on the driving state of the engine defined mainly by the cooling water temperature Tw detected by the water temperature sensor.

The reason why each of the computation formulae is multiplied by 2 is that the basic fuel injection quantity Tp can be used commonly at the normally conducted sequential injection control and at the simultaneous injection control in all the cylinders, which is conducted when the injection quantity becomes large, and this is not an indispensable correction term but may be included into the constant K used for the computation of the basic fuel injection quantity Tp.

The formula for computing the effective injection quantity Tedmy for learning the fuel injection valve (F/I) 6 is different from the formula for computing the normal effective injection quantity Te in that the air-fuel ratio feedback correction coefficient LMD is multiplied by a predetermined value (1.16). By applying this effective injection quantity Tedmy only to one specific cylinder during the period of learning the fuel injection valve 6 where the F/I learning the flag FIl is at zero, the fuel injection quantity Ti (air-fuel ratio) in one cylinder is forcibly changed, and by monitoring the change of the air-fuel ratio feedback correction coefficient LMD on which the influence by the change of the fuel injection quantity Ti is manifested, the error of the supply characteristics of the fuel injection valve 6 of the cylinder to which the effective injection quantity Tedmy has been applied is detected.

At step 69, it is judged whether or not the value of the timer Tmacc is zero. Since the value of this timer Tmacc becomes zero in the stationary driving after a time exceeding the predetermined time has elapsed from the transient driving, when the value of the timer Tmacc is not zero, the engine 1 is in the transient driving state or the driving state is not the stable stationary driving state, and therefore, the routine goes into step 70.

At step 70, a transient flag Facc for judging the transient driving of the engine 1 is set at 1. At next step 71, the F/I learning flag FIl is set at 1 to inhibit the F/I learning.

At step 72, the predetermined value of 16 is set at the normal learning counter nl, and the values of nR and nL counting the frequency of the rich-lean reversal are reset at zero. Furthermore, Σa and Σb integrating the peak values of the air-fuel ratio feedback correction coefficient LMD and ΣTi integrating the fuel injection quantity Ti are reset as zero.

On the other hand, it is judged at step 69 that the value of the timer Tmacc is zero, the routine goes into step 73 and the judgement of the transient flag Facc is conducted. Since 1 is set at the transient flag Facc in case of Tmacc≠0, when the value of Tmacc first becomes zero, it is judged at this step 73 that the flap Facc is at 1, and the routine goes into step 74.

At step 74, the predetermined value of 16 is set at the normal learning counter nl again and zero is set at the transient flag Facc.

At step 4, it is judged whether or not ncyl indicating the number of the cylinder to be learnt indicates 4, and when ncyl indicates 4, 1 is set at ncyl at step 78 and the learning is conducted in the fuel injection valve 6 of #1 cylinder. If ncyl does not indicate 4, the number of ncyl is increased by 1 at step 78 and the learning is conducted in the fuel injection valve 6 of any of #2 cylinder, #3 cylinder and #4 cylinder. Accordingly, every time the number of the timer Tmacc first becomes zero, that is, every time the stationary driving is initially detected, the cylinder where the learning of the fuel injection valve 6 is conducted is changed over to the next cylinder in succession.

At step 79, it is judged whether or not the value of the normal learning counter nl is zero. If the value of the normal learning counter nl is not zero, a predetermined value of 200 is set at the timer Tmacc2 at step 80. If the value of the normal learning counter nl is zero, it is judged at step 81 whether or not the value of the timer Tmacc2 is zero, and if the value is not zero, the routine goes into step 82 and the value of the timer Tmacc2 is decreased by 1.

Figure 8:
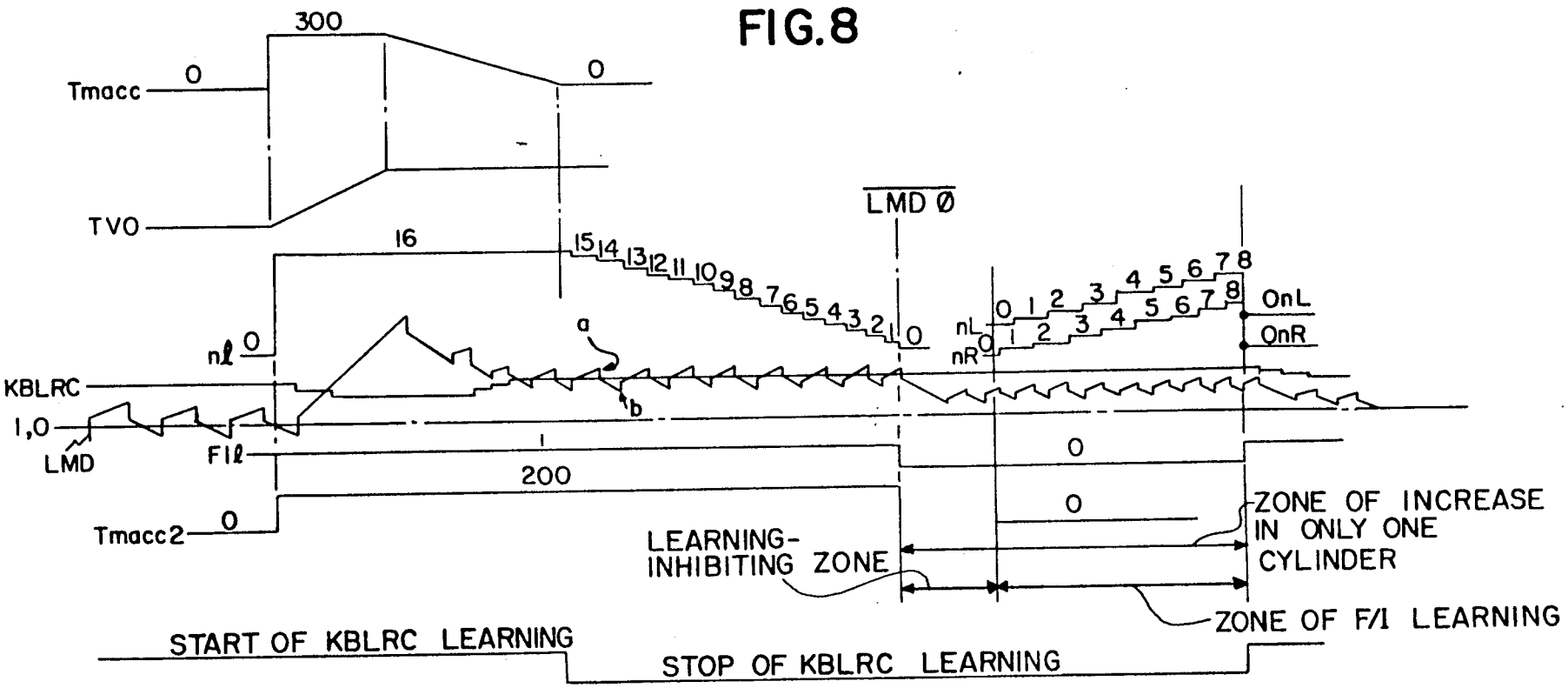
FIG. 8 is a time chart illustrating the control characteristics in the embodiment shown in FIG. 2.

While the normal learning counter nl is counted down from the predetermined value to zero, data of Σa and Σb in the state of the normal fuel control based on the effective injection quantity Te are collected, and next, only the fuel injection value of one specific cylinder is controlled based on the effective injection quantity Tedmy, and during this F/I learning period, data of Σa and Σb are newly obtained, but in the initial stage where use of the effective injection quantity Tedmy has newly begun, the air-fuel ratio feedback correction coefficient LMD is not stable, and therefore, collection of data such as Σa and Σb in the F/I learning state during the time measured by the timer Tmacc2 is inhibited (FIG. 8).

Figures 1, 5:
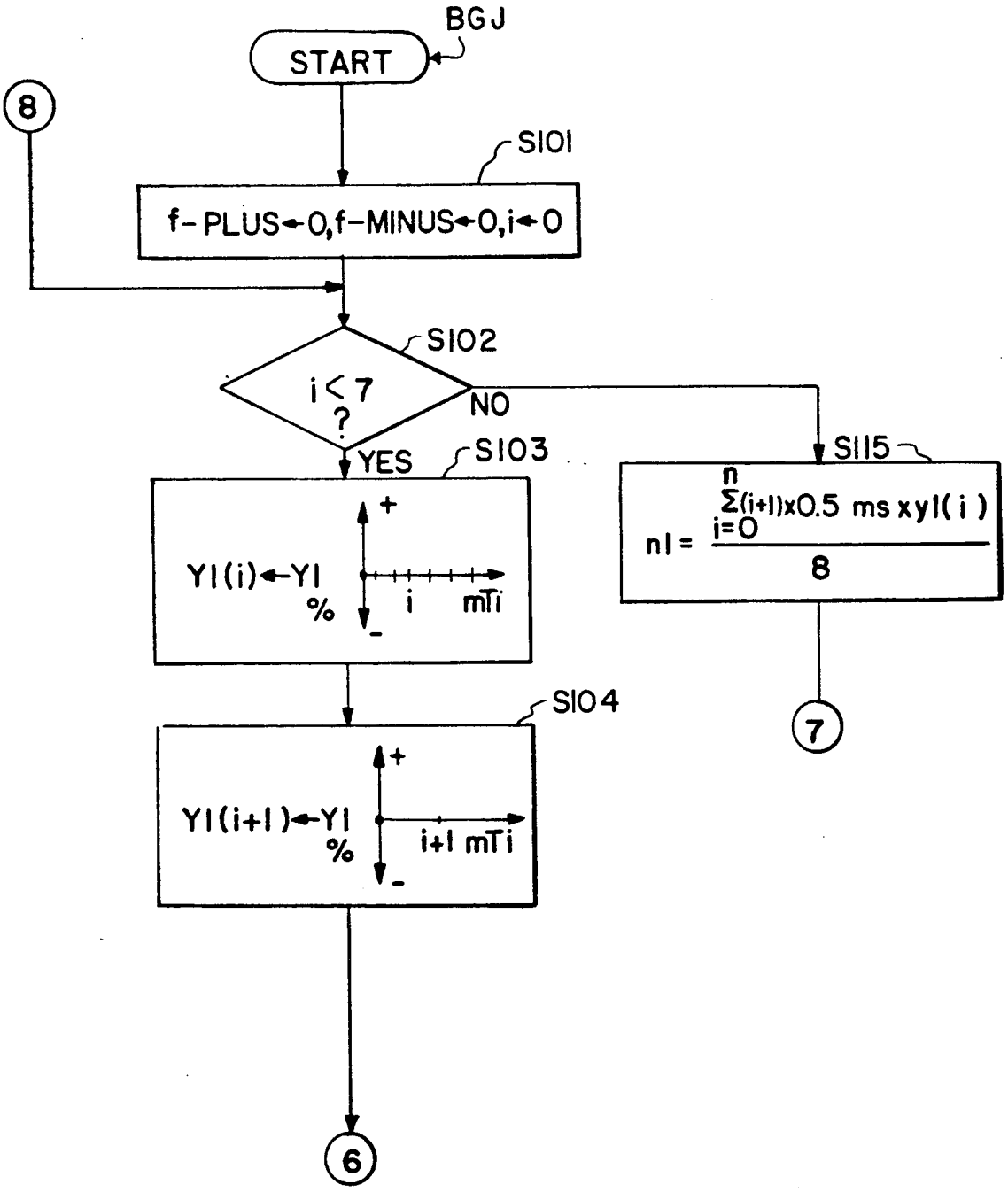
Figures 2, 5:
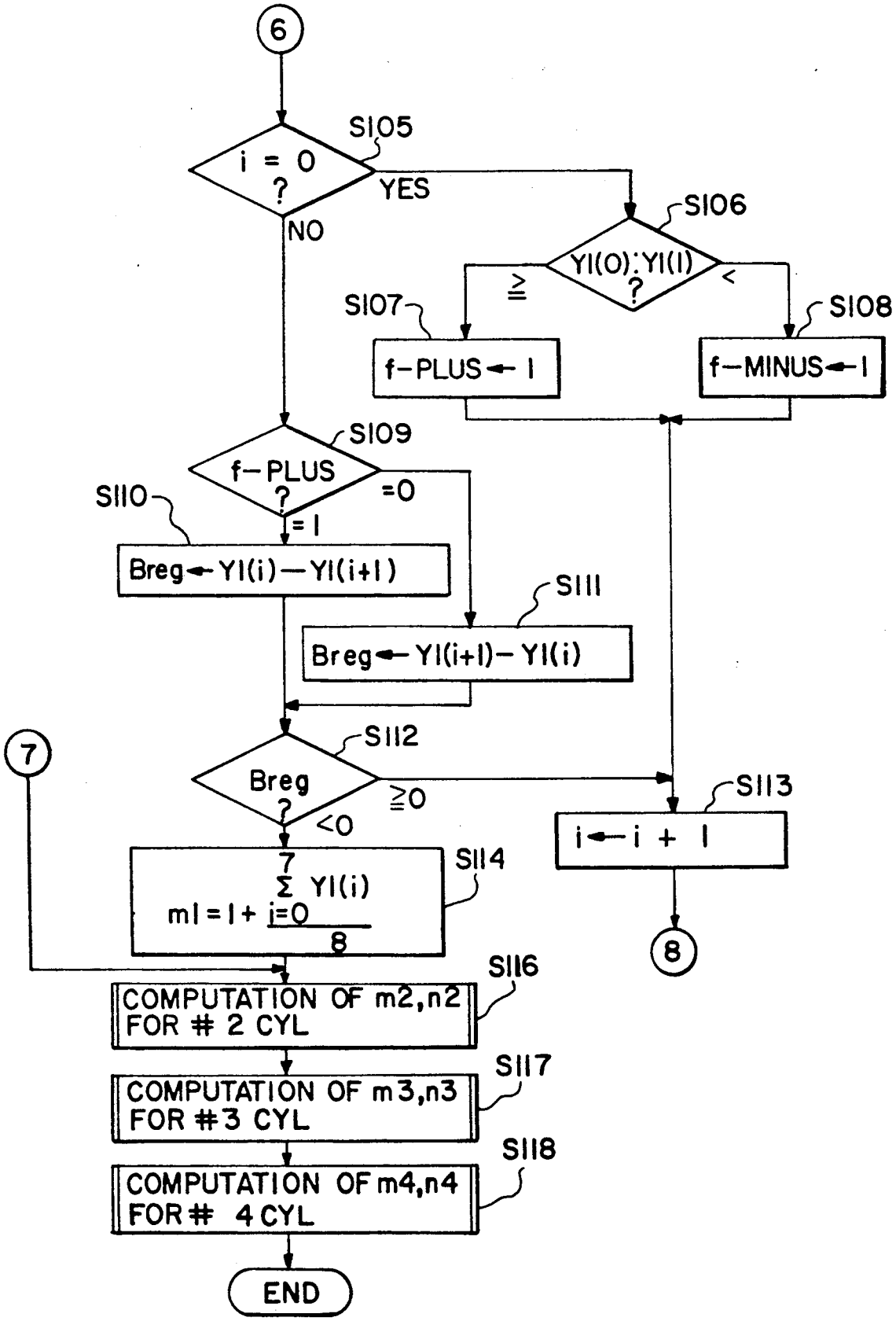

Then, learning and correction of the fuel injection quantity for each cylinder, conducted according to the routine shown in the flow chart of FIG. 5, will be described.

This routine is worked as the background job (BGJ). At first, at step 101, f-plus and f-minus which are flags judging whether or not absolute values of error rates Y1 through Y4 (see steps 53 through 59) of the fuel injection values 6 stored separately for the respective cylinders in correspondence to the fuel injection quantity mTi monotonously decrease with the increase of the fuel injection quantity Ti are reset at zero, and also i indicating the map addresses of the error rates Y1 through Y4 is reset at zero.

At next step 102, it is judged whether or not the number of the address i is smaller than 7, and in case of $1<7$, the routine goes into step 103.

At step 103, the data stored in the address i of the lattice of the fuel injection quantity mTi is read out from the map where the error rate Y1 at the learning of the fuel injection value 6 of #1 cylinder is stored in correspondence to the fuel injection quantity mTi, and the value of the data is set at y1(i).

At step 104, the data stored at address i+1 subsequent to address i at step 103 in the map of Y1 is read out and the value of the data is set at y1(i+1).

At next step 105, it is judged whether or not address i is at zero, and if address i is at zero when the routine first goes into step 102 from step 101, the routine goes into step 106. At step 106, the error rate y1(0) of the fuel injection valve 6 of #1 cylinder at address i=0 is compared with y1(1) at next address i=1. When y1(0) is larger, the routine goes into step 107, and 1 is set at f-plus where zero has been reset at step 101. If y1(1) is larger, the routine goes into step 108, 1 is set at f-minus where zero is reset at step 101.

As described hereinafter, the cause of the error Y1 can be discriminated by examining whether or not the change of y1 expressed by f-plus and f-minus set in the above-mentioned manner continues even when the number of address i is increased, and a correction term matched with the error cause can be set.

At step 113, the number of address i is increased by 1. Accordingly, if the routine goes into step 106 in the state where address i is at zero, address i is set at 1 at this step.

If the number of address i is increased by 1 at step 113, the routine returns to step 102, and since the number of address i is smaller than 7, the computations of steps 103 and 104 are repeated, but since it is judged at step 105 that the number of address i is not zero, the routine goes into step 109.

At step 109, it is judged whether or not f-plus set when address i is at zero is at 1 or zero. If f-plus is at 1, the routine goes into step 110 and [y1(i)−y1(i+1)] is set at Breg. If f-plus is at zero and f-minus is at 1, the routine goes into step 111, and [y1(i+1)−y1] is set at Breg.

At step 112, it is judged whether the above-mentioned Breg is positive or negative, and if Breg is positive, the routine goes into step 113 and the number of address i is increased by 1. Then, computing processings of steps 102 through 104 are repeated again.

Figure 10:
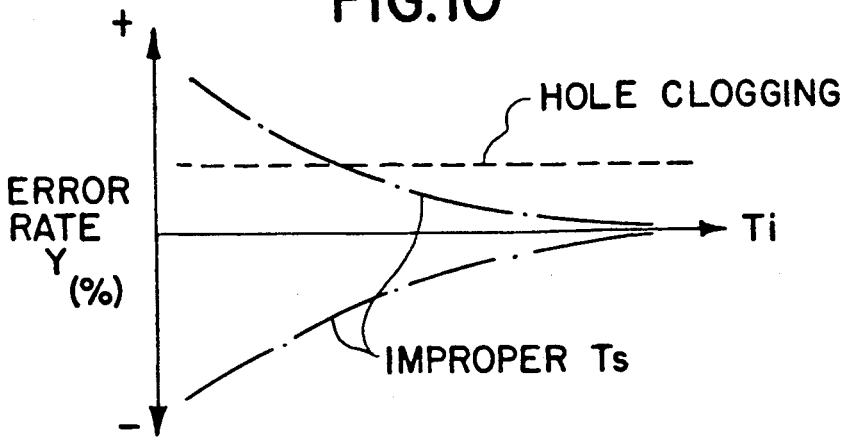
FIG. 10 is a graph illustrating the relation between the quantity of the error of the supply characteristics and the fuel injection quantity.

Namely, as shown in FIG. 10, when the absolute value of the error rate y1(i) monotonously decreases with increase of the fuel injection quantity Ti (Ts is not good), for example, if f-plus is 1, [y1(i)−y1(i+1)] should be normally positive, and if f-minus is 1, [y1-(i+1)−Y1(i)] should be normally positive. Accordingly, when it is judged at step 112 that Breg is positive, the absolute value of the error rate y1(i) monotonously decreases with increase of the fuel injection quantity Ti.

If Breg is positive, the number of address i is increased by 1 at step 113, and the routine comes back to step 102 again. Thus, it is confirmed that Breg is positive, until the number of address i is increased to 7.

If the monotonous decrease of the absolute value of the error rate y1(i) with increase of the fuel injection quantity Ti is continuously judged until the number of address i is increased to 7, the routine goes into step 115 from step 102.

At step 115, in order to correct the correction portion Ts by the battery voltage, used for computing the fuel injection quantity Ti, the correction portion n1 (first correction value for #1 cylinder is calculated according to the following formula:

$$n1 = \frac{\sum_{i=0}^{7} (i+1) \times 0.5\ \text{ms} \times y1(i)}{8}$$

The fuel injection quantity Ti is set at the opening time ms of the fuel injection valve 6, and in the map of error rates Y0 and Y1 through Y4, when the number of address is 1, the fuel injection quantity Ti is 0.5 ms, and as the number of address i increases by 1, the fuel injection quantity Ti increases by 0.5 ms. Accordingly, (i+1)×0.5 ms is the fuel injection quantity Ti corresponding to address i, and also corresponding to the error rate y1(i) in the fuel injection valve 6 of #1 cylinder corresponding to this fuel injection quantity Ti.

If the fuel for #1 cylinder is corrected by a certain quantity, when the fuel injection quantity Ti is larger, no effect is manifested by this correction, and when the fuel injection quantity is small, the effect by this correction is manifested. If the correction by a certain quantity is superfluous or insufficient, the error of the fuel control is larger as the fuel injection quantity Ti is smaller. In the computation of the normal fuel injection quantity, the correction portion Ts for correcting the change of the effective opening time (the opening or closing delay time) of the fuel injection valve 6 caused by the change of the voltage of the battery as the driving power source is added to the effective injection quantity Te. However, if this correction portion Ts which is the certain correction quantity is made sufficient or superfluous by deterioration of the fuel injection valve 6, since the fuel supply error rate is larger as the fuel injection quantity Ti is smaller, as pointed out hereinbefore, the monotonous decrease of the absolute value of the error rate y1(i) with increase of the fuel injection quantity Ti is regarded as being due to the insufficiency or superfluousness of the correction proportion Ts.

The product of the error rate y1(i) and the fuel injection quantity Ti corresponds to the insufficiency or superfluousness of the correction proportion Ts, and in the formula of the computation of n1, the insufficiency or superfluousness of Ts computed at each address i is averaged.

On the other hand, if it is judged at step 112 that Breg is negative, this means that a change is caused relatively to the change direction observed when the number of address i is zero, and as shown in FIG. 10 illustrating the abnormal state of Ts, it cannot be said that the absolute value of the error rate y1(i) shows a monotonous decrease. Accordingly, the routine goes into step 114 without confirming tendency of the change until the number of address i becomes 7.

At step 114, the correction coefficient m1 (second correction value) for correcting the effective injection quantity Te (basic fuel injection quantity Tp) at a certain ratio in calculating the fuel injection quantity Ti for #1 cylinder is computed according to the following formula:

$$m1 = 1 + \frac{\sum_{i=0}^{7} y1(i)}{8}$$

In the case where the absolute value of the error rate y1(i) does not monotonously change with increase of the fuel injection quantity Ti but is almost constant as shown in "clogging of injection holes" in FIG. 10, this error rate is eliminated by correcting the effective injection quantity Te (basic fuel injection quantity Tp) at a certain ratio.

Figure 9:
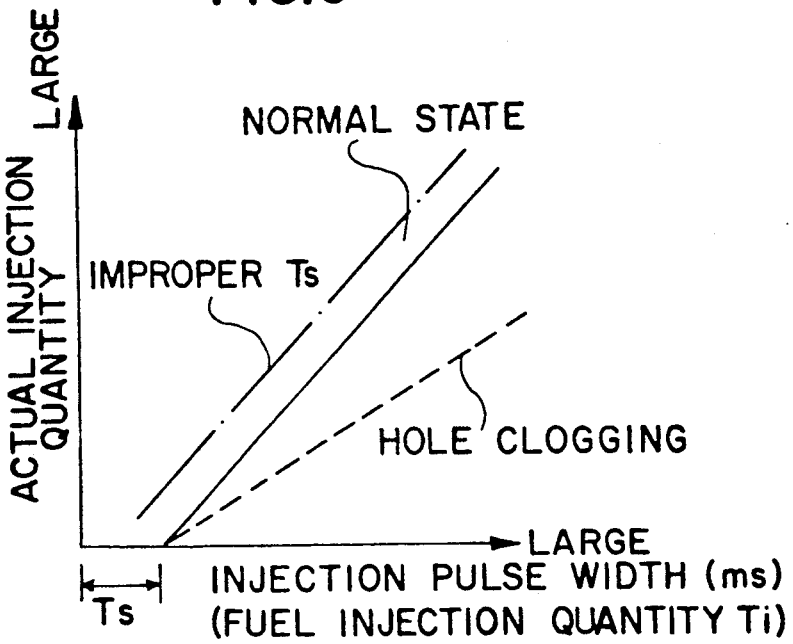
FIG. 9 is a graph illustrating an example of occurrence of an error of supply characteristics in a fuel injection value.

For example, if one of a plurality of injection holes is clogged, the error rate y1(i) shows a tendency as shown in Table 10, and the actual injection quantity changes relatively to the fuel injection quantity Ti (opening time) as shown in FIG. 9. In order to compensate this error of the supply characteristics by clogging of the injection hole, the inclination of the actual injection quantity to the fuel injection quantity Ti (pulse width) in FIG. 9 is apparently corrected by multiplying the effective injection quantity Te by the correction coefficient.

Incidentally, the error rate y1(i) means that even though the effective injection quantity Te of #1 cylinder is multiplied by the predetermined value Z, the actually obtained result is the same as the result obtained by multiplication by [predetermined value Z−error rate y1(i)]. Accordingly, in order to obtain the desired fuel quantity actually, the effective injection quantity Te should be multiplied by [1+error rate y1(i)], and the correction coefficient m1 for correcting the effective injection quantity Te (basic fuel injection quantity Tp) for #1 cylinder is set by adding 1 to the mean value of y1(i) in each address i.

Based on the supply characteristic error rate Y1 determined when the fuel injection valve 6 of #1 cylinder is learnt, the correction portion n1 for correcting the fuel injection quantity Ti of #1 cylinder by a constant quantity and the correction portion m1 for correcting the basic fuel injection quantity Tp at a certain rate are learnt, and correction terms n2 through n4 and m2 through m4 for #2 cylinder, #3 cylinder and #4 cylinder are similarly learnt and set at steps 116 through 118 as at the above-mentioned steps 101 through 114.

Figures 1, 6:
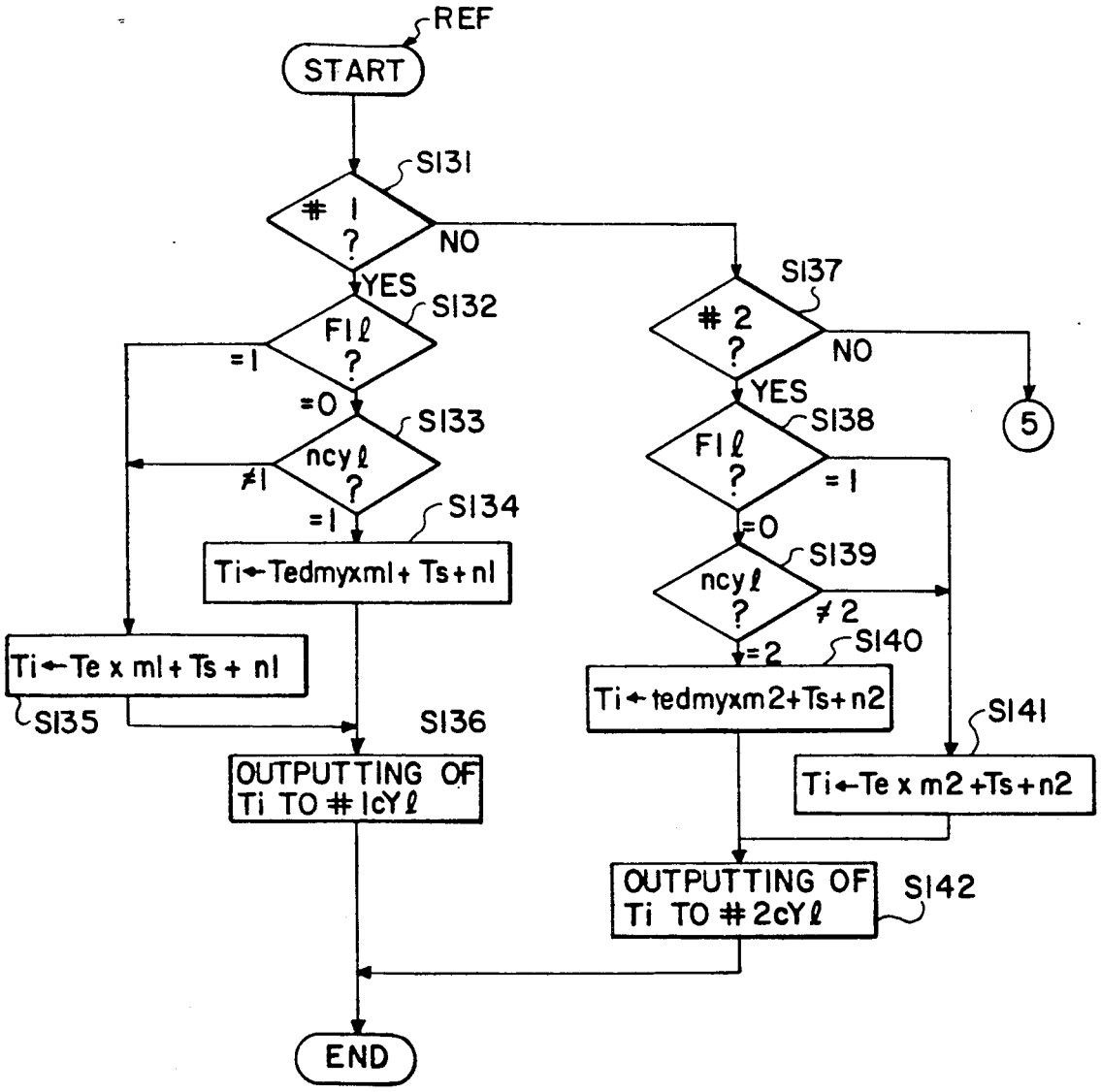
Figures 2, 6:
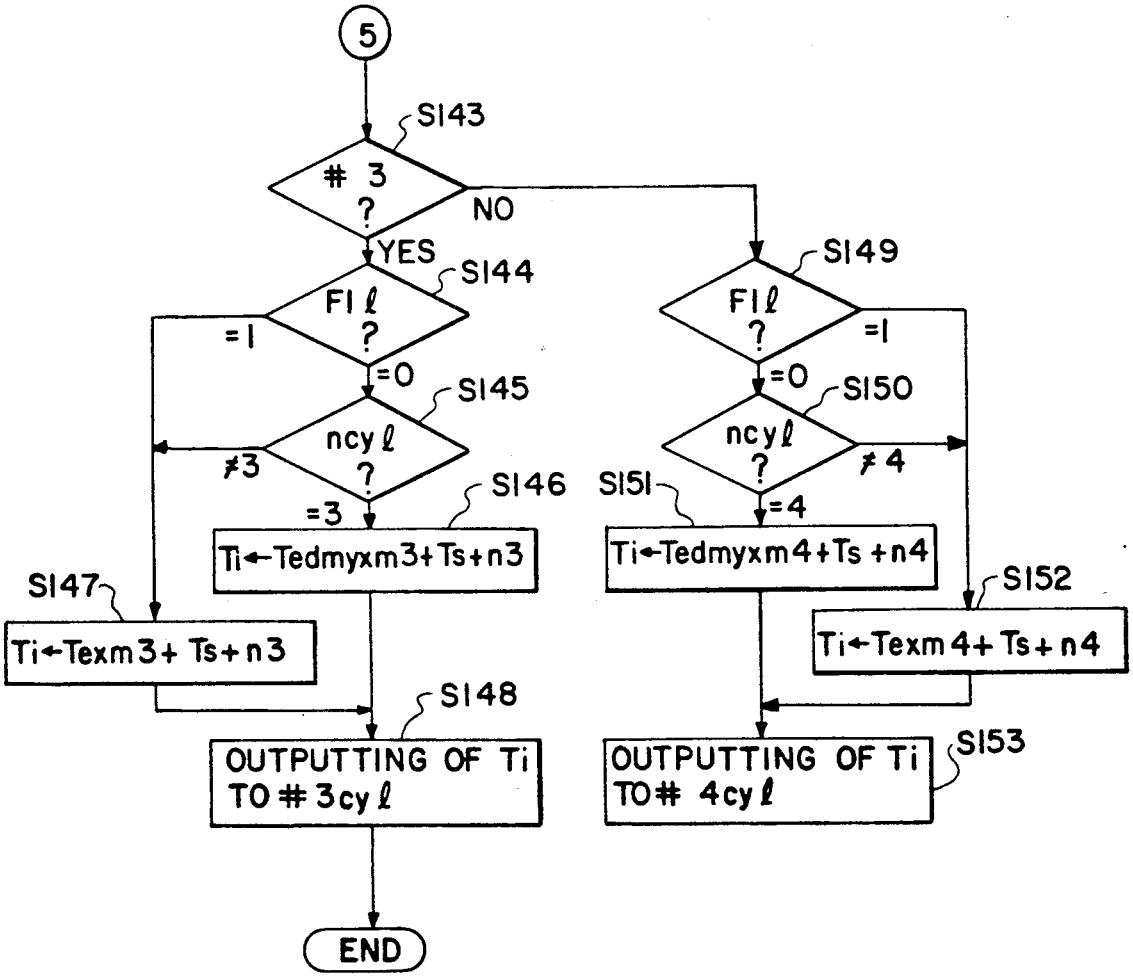

The thus learnt and set correction terms n1 through n4 (first correction values) and m1 through m4 (second correction values) are used for the computation of the fuel injection quantities Ti for the respective cylinders in the fuel supply control routine shown in the flow chart of FIG. 6. For the respective cylinders, injection and supply of the fuel are controlled according to the fuel injection quantities Ti learnt and corrected according to the supply characteristic errors Y1 through Y4 of the fuel injection valves 6.

The routine shown in the flow chart of FIG. 6 is worked every time the reference angle signal REF is outputted from the crank angle sensor 14 at every 180° in case of a 4-cylinder engine, and the supply of the fuel into each cylinder is initiated synchronously with the intake stroke of each cylinder at every reference angle signal REF. This fuel control is generally called sequential injection control.

At first, at step 131, it is judged whether or not the present reference angle signal REF corresponds to the time of initiation of supply of the fuel to #1 cylinder, and when the signal REF is for #cylinder, the routine goes into 132. The reference angle signal REF outputted from the crank angle sensor 14 may be such that the pulse width is made different among the signals for the respective cylinders and the corresponding cylinder can be judged by measuring the pulse width.

At step 132, the F/l learning flag Fll is judged, and when the F/l learning flag Fll is at 1 and learning of the fuel injection valve 6 is not carried out, the routine goes into step 135 and the fuel injection quantity (fuel supply quantity) Ti for #1 cylinder is computed based on the effective injection quantity Te(=2×Tp×LMD×COEF×KBLRC) for the normal injection, computed at step 68 commonly to the respective cylinders, the correction terms m1 and n1 learnt and set for #1 cylinder and the correction portion Ts set commonly to the respective cylinders based on the battery voltage according to the following formula:

$$Ti \leftarrow Te \times m1 + Ts + n1$$

When it is judged at step 132 that the F/l learning flag Fll is at zero, the supply characteristic error of the fuel injection valve 6 of the corresponding cylinder should be detected by using the effective injection quantity Tedmy(=2×Tp×(LMD×1.16)×COEF×KBLRC) for the computation of the fuel injection quantity Ti of one specific cylinder. Accordingly, the routine goes into step 133 and it is judged whether or not ncyl s 1 and whether or not the fuel injection valve 6 of #1 cylinder should be learnt by the present F/l learning.

If ncyl is 1, the above-mentioned effective injection quantity Tedmy is used for the computation of the fuel injection quantity Ti of #1 cylinder, whereby the air-fuel ratio (fuel quantity) of #1 cylinder is forcibly shifted, and it is watched whether or not the result of this shifting is manifested on the change of the air-fuel ratio feedback correction coefficient LMD, as expected. Therefore, at step 134, the fuel injection quantity Ti for #1 cylinder is computed by using the effective injection quantity Tedmy according to the following formula:

$$Ti \leftarrow Tedmy \times m1 + Ts + n1$$

Thus, during the period of the learning of F/l or when #1 cylinder is designated by this learning, the fuel injection quantity Ti for #1 cylinder is computed at step 134 or step 135, and at next step 136, a driving pulse signal having a pulse width corresponding to the computed fuel injection quantity Ti is outputted to the fuel injection valve 6 of #1 cylinder and injection and supply of the fuel to #1 cylinder are performed.

When it is judged at step 131 that the present reference angle signal REF does not correspond to the time of initiation of the injection into #1 cylinder, the routine goes into step 137 and it is judged whether or not the present reference angle signal REF corresponds to the time of initiation of the fuel into #2 cylinder.

When the present reference angle signal REF corresponds to the time of initiation of the injection into #2 cylinder, as in the above-mentioned case of #1 cylinder, during the period of the learning of F/i or when #2 cylinder is designated by this learning (step 138 or step 139), the fuel injection quantity Ti for #2 cylinder is computed at step 140 or step 141, and a driving pulse signal having a pulse width corresponding to the computed fuel injection quantity Ti is outputted to the fuel injection valve 6 of #2 cylinder.

When it is judged at step 137 that the present reference angle signal REF does not correspond to the time of insulation of the injection in #2 cylinder, the routine goes into step 143 and it is judged whether or not the reference angle signal REF corresponds to the time of initiation of the injection into #3 cylinder.

When the present reference angle signal REF corresponds to the time of initiation of the injection in #3 cylinder, during the period of the learning of F/l or when #3 cylinder is designated by this learning (step 144 or step 145), as in the above-mentioned case, the fuel injection quantity Ti for #3 cylinder is computed at step 146 or step 147, and a driving pulse signal having a pulse width corresponding to the fuel injection quantity Ti is outputted to the fuel injection valve 6 of #3 cylinder.

When it is judged at step 143 that the reference angle signal REF does not correspond to the time of initiation of the injection into #3 cylinder, the cylinder for which the injection is now to be initiated is remaining #4 cylinder, and similarly, during the period of the learning of F/l or when #4 cylinder is designated by this learning (step 149 or step 150), the fuel injection quantity Ti for #4 cylinder is computed at step 151 or step 152 and a driving pulse signal having a pulse width corresponding to the fuel injection quantity Ti is outputted to the fuel injection valve 6 of #4 cylinder at step 153.

In the manner as described above, supply characteristic error rates Y1 through Y4 of the fuel injection valves 6 of respective cylinders are detected, correction terms n1 through n4 and m1 through m4 are set so that these error rates Y1 through Y4 are compensated and the fuel injection quantities Ti are controlled in correspondence to these error rates Y1 through Y4 separately for the respective cylinders. Accordingly, even if there are differences of supply characteristics among the fuel injection valves 6 of the respective cylinders, the air-fuel ratios of the respective cylinders can be controlled to levels close to the target air-fuel ratio, and furthermore, worsening of properties of exhaust gas caused by differences of the air-fuel ratio among the respective cylinders and occurrence of misfire in a specific cylinder can be obviated.

As is apparent from the foregoing description, since the supply characteristic error rates Y of the fuel injection valves 6 of the respective cylinders are detected separately and correction terms m1 through m4 and n1 through n4 are learnt and set based on these error rates Y separately for the respective cylinders, abnormal states of the fuel injection valves 6 of the respective cylinders can be diagnosed separately based on the detected error rates Y1 through Y4 or based on the correction terms m1 through m4 and n1 through n4 corresponding to the error rates Y1 through Y4.

Figure 7:
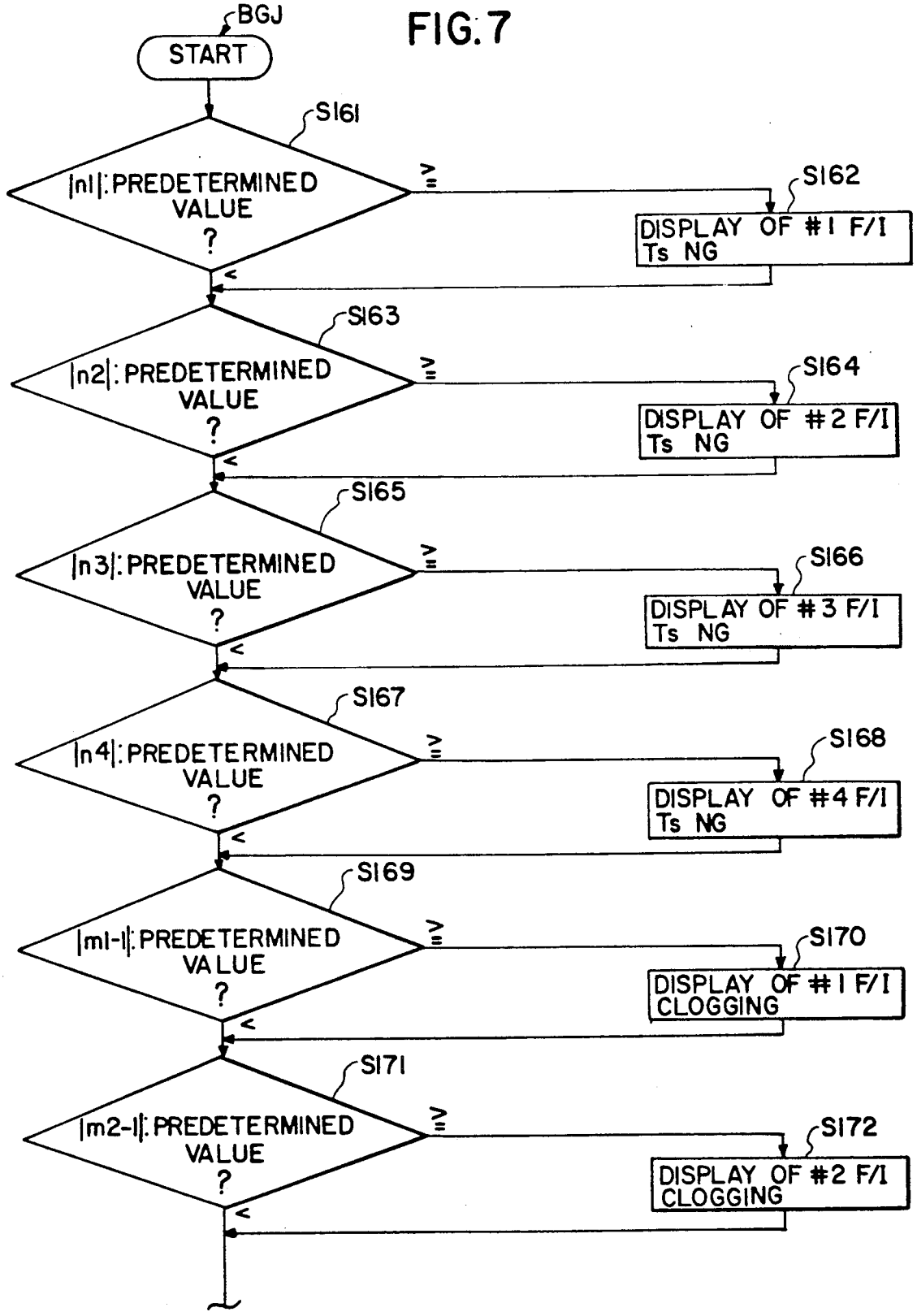
Figure 7:
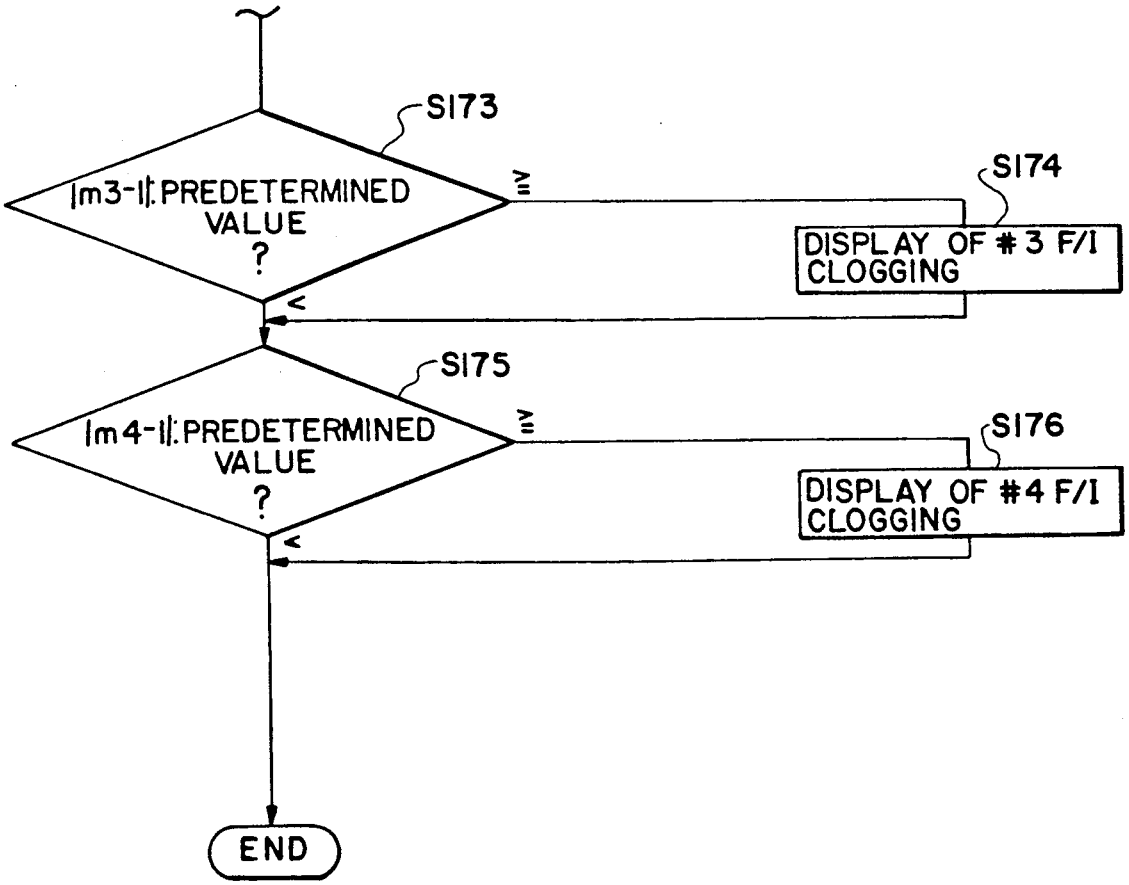

In the present embodiment, the diagnosis of the abnormal state of the fuel injection valve 6 is carried out for each cylinder based on the correction terms m1 through m4 and n1 through n4 according to the routine shown in the flow chart of FIG. 7.

The routine shown in the flow chart of FIG. 7 is worked as the background job (BGJ). At step 161, it is judged whether or not the absolute value of the correction portion n1 for correcting the battery voltage correction portion Ts in #1 cylinder exceeds a predetermined level.

If the absolute value of n1 exceeds the predetermined value, it is indicated that in the fuel injection valve 6 of #1 cylinder, though desired voltage correction (correction of the opening or closing delay) is substantially attained by Ts common to all the cylinders in the initial state, desired fuel injection becomes impossible unless Ts is greatly corrected (in general, to the positive side). Accordingly, the routine goes into step 162, and improper battery voltage correction portion Ts (NG) is displayed, for example, on a dashboard of the vehicle and a driver is informed that deterioration with time has been caused in the fuel injection valve 6 and the opening or closing delay characteristics have been changed.

Similarly, it is judged whether or not the absolute values of the correction portions n2, n3 and n4 for #2 cylinder, #3 cylinder and #4 cylinder exceed the predetermined value (steps 163, 165 and 168), and if the absolute values of the correction portions n2, n3 and n4 are larger than the predetermined value, improper battery voltage correction portions Ts in the fuel injection valves 6 of the corresponding cylinders are displayed (steps 164, 166 and 168).

Incidentally, instead of the above-mentioned method where the absolute values of n1 through n4 are compared with the predetermined value, there can be adopted a modification in which the injection quantity Ti at the idle driving $[=(Ti_{idle}+n1, n2, n3 \text{ or } n4)/Ti_{idle}]$ is computed, and if the obtained value is, for example, smaller than 0.92 or larger than 1.45, Ts of the corresponding cylinder is improper. If this modification is adopted, the abnormality can be judged at different levels in both of the increasing correction and decreasing correction of n1 through n4.

At step 169, it is judged whether or not the absolute value of the value obtained by subtracting the reference value of 1 from the correction coefficient m1 learnt and set for correcting the effective injection quantity Te of #1 cylinder exceeds a predetermined value.

For example, clogging is caused in injection holes of the fuel injection value 6 #1 cylinder, even if the fuel injection quantity Ti of #1 cylinder is increased by the predetermined value Z (1.16 in the present embodiment), the fuel is not injected in the amount increased by a quantity corresponding to the predetermined value Z, m1 is set at a value exceeding 1, and as the clogging degree increases, m1 becomes a larger value. Therefore, the value obtained by subtracting 1 from m1 indicates the correction degree. Therefore, the absolute value of this obtained value is compared with the predetermined value to diagnose the fuel injection valve 6 of #1 cylinder.

When the absolute value of (m1 − 1) exceeds the predetermined value, the routine goes into step 170 and clogging of injection holes in the fuel injection valve 6 of #1 cylinder is displayed, for example, on a dashboard of the vehicle, as in the above-mentioned case of improper Ts, to inform the driver of this abnormality.

In the fuel injection valve 6 of #1 cylinder, if the quantity of the injected fuel to the pulse width of the driving pulse signal becomes larger than in the initial stage, m1 is learnt and set at a value smaller than 1, and if leakage becomes vigorous, the absolute value of (m1 − 1) sometimes exceeds the above-mentioned predetermined value, but in the present embodiment, clogging of injection holes is simply displayed. Of course, there can be adopted a method in which the increasing correction where m1 exceeds 1 is distinguished from the decreasing correction where m1 is smaller than 1 and the display of the result of the abnormality diagnosis is changed over.

Similarly, it is judged whether or not the absolute values of the values obtained by subtracting the reference value of 1 from the correction coefficients m2, m3 and m4 of #2 cylinder, #3 cylinder and #4 cylinder exceed the predetermined value (steps 171, 173 and 175), and if these absolute values exceed the predetermined value, occurrence of clogging of injection holes in the fuel injection valves of the corresponding cylinders is displayed (steps 172, 174 and 176).

Instead of the above-mentioned method in which the absolute values of (m1, m2, m3 or m4 − 1) are compared with the predetermined value, there can be adopted a modification in which occurrence of injection holes of the corresponding cylinder is judged and displayed when m1, m2, m3 or m4 is smaller than 0.92 or larger than 1.45, and in this modification, the abnormality is diagnosed at different levels in the increasing correction and the decreasing direction.

In the routine shown in the flow chart of FIG. 7, the abnormality is diagnosed according to the levels of the correction terms n1 through n4 and m1 through m4, but in the routine shown in the flow chart of FIG. 3, the diagnosis of the fuel injection valve 6 of each cylinder can be independently diagnosed based on the level of the error rate Y stored in correspondence to the fuel injection quantity Ti of the corresponding cylinder. More specifically, at step 47 of the routine shown in the flow chart of FIG. 3, when the air-fuel ratio feedback correction coefficient LMD is not changed even though the fuel quantity is corrected in one specific cylinder and the air-fuel ratio is forcibly shifted, it is judged that the fuel injection valve 6 of this specific cylinder is in the uncontrollable state. However, there can also be adopted a method in which when the absolute value of the error quantity Y determined at step 44 is larger than a predetermined value (for example, 0.06) and the difference of the change of the air-fuel ratio feedback correction coefficient LMD expected by the correction of the fuel quantity made in one specific cylinder from the actual change is large, the abnormality (NG) of the fuel injection valve 6 of this specific cylinder is diagnosed (step 180).

If it is indicated separately for respective cylinders whether the errors of the supply characteristics in fuel injection valves 6 of the respective cylinders are due to the change of the opening or closing delay by deterioration or to clogging of injection holes, in each cylinder it can be easily judged whether the fuel injection valve 6 should be exchanged or washed, and the maintenance can be simplified.

Incidentally, in the present embodiment, the air flow meter 13 is disposed and the basic fuel injection quantity Tp is computed based on the sucked air flow quantity Q detected by this air flow meter and the engine revolution number N. However, there can be adopted a modification in which a pressure sensor is disposed instead of the air flow meter 13 and the basic fuel injection quantity Tp is computed based on the sucked air pressure and the engine revolution number N.

INDUSTRIAL APPLICABILITY

As as apparent from the foregoing description, the apparatus for detecting errors separately for respective cylinders, the apparatus for performing the learning separately for respective cylinders and the apparatus for making the diagnosis separately for respective cylinders in the fuel supply control system of an internal combustion engine according to the present invention are especially suitable for performing the air-fuel ratio control in an electronically controlled fuel injection type internal combustion engine and are very effective for increasing the quality and performances.

What is claimed is:

1. An apparatus for controlling a plurality of respective cylinders in a fuel supply system of an internal combustion engine, comprising:

driving state-detecting means for detecting the engine driving state including at least the state quantity participating in the quantity of air sucked in the engine;

basic fuel supply quantity-setting means for setting the basic fuel supply quantity based on the detected driving state;

air-fuel ratio-detecting means for detecting exhaust gas components in a junction of exhaust gas paths of respective cylinders and detecting the air-fuel ratio in an air/fuel mixture sucked in the engine based on the result of the detection of the exhaust gas components;

air-fuel ratio feedback correction value-setting means for setting an air-fuel ratio feedback correction value for correcting the basic fuel supply quantity to bring the detected air-fuel ratio close to the target air-fuel ratio;

fuel supply quantity-setting means for setting the fuel supply quantity based on the basic fuel supply quantity and the air-fuel ratio feedback correction value;

fuel-supplying means disposed separately for respective cylinders and fuel supply-controlling means for driving and controlling the fuel supply means based on the set fuel supply quantity;

an apparatus for detecting errors separately for said respective cylinders, which comprises error-detecting fuel supply quantity setting means for setting an error-detecting fuel supply quantity for detecting errors of supply characteristics of fuel supply means based on said air-fuel ratio feedback correction value, a predetermined value for correcting said air-fuel ratio feedback correction value and a basic fuel supply quantity;

error-detecting fuel supply-controlling means for controlling driving of the fuel supply means of a specific one of said cylinders for a predetermined time based on said error-detecting fuel supply quantity and error quantity-detecting means for detecting a quantity of error in supply characteristics of the fuel supply means of the respective cylinders separately by comparing the air-fuel ratio feedback correction value set while the fuel supply of the specific one of said cylinders is controlled by said error-detecting fuel supply-controlling means, with the air-fuel ratio feedback correction value set while the fuel supply means of all the cylinders are driven and controlled based on the normal fuel supply quantity corresponding to the driving state.

2. The apparatus for controlling said respective cylinders in the fuel supply control system of the internal combustion engine as set forth in claim 1, further comprising:

averaging means for averaging the air-fuel ratio feedback correction value set by air-fuel ratio feedback correction value-setting means and performing the comparison with the air-fuel ratio feedback correction value by the error quantity-detecting means based on the averaged value.

3. The apparatus for controlling said respective cylinders in the fuel supply control system of the internal combustion engine as set forth in claim 1 further comprising error quantity detection-allowing means for allowing the driving control of the fuel supply means by the error-detecting fuel supply-controlling means and sampling of the air-fuel feedback correction value to be compared by the error quantity-detecting means only in the stationary driving state after the passage of a time longer than a predetermined time for the transient driving state of the engine.

4. The apparatus for controlling said respective cylinders in the fuel supply control system of the internal combustion engine as set forth in claim 1, further comprising error quantity-storing means for storing the quantity of the error of supply characteristics; and correction value-learning and setting means for setting a first correction value for each of said cylinders based on the quantity of the error in the supply characteristics for increasing or decreasing and correcting the fuel supply quantity only by a certain amount for each of said cylinders when the absolute value of the quantity of the error in the supply characteristics stored in said error quantity-storing means for each of said cylinders shows a monotonous decrease in correspondence to an increasing change of the fuel supply quantity in the corresponding one of said cylinders and also setting a second correction value based on the quantity of the error of the supply characteristics for each of said cylinders for correcting the basic fuel supply quantity of the corresponding one of said cylinders when the quantity of the error of the supply characteristic shows a change other than said monotonous decrease, and fuel supply quantity-correcting means for correcting the fuel supply quantity set by fuel supply quantity-setting means based on the first and second correction values set for each of said cylinders by the correction value-learning and setting means to set fuel supply quantity for each of said cylinders, and effecting the driving control of the fuel supply means by the fuel supply-controlling means based on the set fuel supply quantity for each of said cylinders.

5. The apparatus for controlling the respective cylinders in the fuel supply control system of the internal combustion engine as set forth in claim 1, further comprising means for judging an abnormality for each of said cylinders, which is disposed so that when the quantity of the error of the supply characteristics in each of said cylinders detected by said error quantity-detecting means exceeds a predetermined tolerance limit value, an occurrence of the abnormality in the corresponding one of said cylinders is judged.

6. The apparatus for controlling said respective cylinders in the fuel supply control system of the internal combustion engine according to claim 2, which further comprises error quantity detection-allowing means for allowing the driving control of the fuel supply means by the error-detecting fuel supply-controlling means and sampling of the air-fuel feedback correction value to be compared by the error quantity-detecting means only in the stationary driving state after the passage of a time longer than a predetermined time from the transient driving state of the engine.

7. The apparatus for controlling said respective cylinders in the fuel supply control system of the internal combustion engine as set forth in claim 2, further comprising error quantity-storing means for storing the quantity of the error of supply characteristics; correction value-learning and setting means for setting a first correction value for each of said cylinders based on the quantity of the error in the supply characteristics for increasing or decreasing and correcting the fuel supply quantity only by a certain amount for each of said cylinders when the absolute value of the quantity in the error of the supply characteristics stored in said error quantity-storing means for each of said cylinders shows a monotonous decrease in correspondence to an increasing change of the fuel supply quantity in the corresponding one of said cylinders and also setting a second correction value based on the quantity of the error of the supply characteristics for each of said cylinders for correcting the basic fuel supply quantity of the corresponding one of said cylinders when the quantity of the error of the supply characteristics shows a change other than said monotonous decrease, and fuel supply quantity-correcting means for correcting the fuel supply quantity set by fuel supply quantity-setting means based on the first and second correction values set for each of said cylinders by the correction value-learning and setting means to set a fuel supply quantity for each of said cylinders, and effecting the driving control of the fuel supply means by fuel supply-controlling means based on the set fuel supply quantity for each of said cylinders.

8. The apparatus for controlling said respective cylinders in the fuel supply control system of the internal combustion engine as set forth in claim 3, further comprising error quantity-storing means for storing the quantity of the error of supply characteristics; correction value-learning and setting means for setting a first correction value for each of said cylinders based on the quantity of the error in the supply characteristics for increasing or decreasing and correcting the fuel supply quantity only by a certain amount for each of said cylinders when the absolute value of the quantity of the error of the supply characteristics stored in said error quantity-storing means for each of said cylinders shows a monotonous decrease in correspondence to an increasing change of the fuel supply quantity in the corresponding one of said cylinders and also setting a second correction value based on the quantity of the error of the supply characteristics for each of said cylinders for correcting the basic fuel supply quantity of the corresponding one of said cylinders when the quantity of the error of the supply characteristics shows a change other than said monotonous decrease, and fuel supply quantity-correcting means for correcting the fuel supply quantity set by fuel supply quantity-setting means based on the first and second correction values set for each of said cylinders by the correction value-learning and setting means to set a fuel supply quantity for each of said cylinders, and effecting the driving control of the fuel supply means by fuel supply-controlling means based on the set fuel supply quantity for each of said cylinders.

9. The apparatus for controlling said respective cylinders in the fuel supply control system in the internal combustion engine as set forth in claim 2, further comprising means for judging an abnormality for each of said cylinders, which is disposed so that when the quantity of the error of the supply characteristics in each of said cylinders detected by said error quantity-detecting means exceeds a predetermined tolerance limit value, an occurrence of the abnormality in the corresponding one of said cylinders is judged.

10. The apparatus for controlling said respective cylinders in the fuel supply control system of the internal combustion engine as set forth in claim 3, further comprising means for judging an abnormality for each of said cylinders, which is disposed so that when the quantity of the error of the supply characteristics in each of said cylinders detected by said error quantity-detecting means exceeds a predetermined tolerance limit value, an occurrence of abnormality in the corresponding one of said cylinders is judged.

11. The apparatus for controlling said respective cylinders in the fuel supply control system of the internal combustion engine as set forth in claim 4, which comprises means for judging an abnormality for each of said cylinders, which is disposed so that when the first and the second correction values for each of said cylinders set by said correction value-learning and setting means exceeds a predetermined tolerance limit value, an occurrence of the abnormality in one of the corresponding cylinders is judged.

* * * * *